US005546917A

United States Patent [19]

Osanai et al.

[11] Patent Number: 5,546,917

[45] Date of Patent: Aug. 20, 1996

[54] APPARATUS FOR DISPOSING OF FUEL VAPOR

[75] Inventors: Akinori Osanai, Susono; Toshinari Nagai, Shizuoka; Hiroshi Kanai; Kenji Harima, both of Susono; Kazuhiko Iwano, Aichi; Shuji Yuda, Susono, all of Japan

[73] Assignee: Toyota Jidosha Kabushiki Kaisha, Toyota, Japan

[21] Appl. No.: 405,328

[22] Filed: Mar. 16, 1995

[30] Foreign Application Priority Data

Mar. 30, 1994 [JP] Japan ..... 6-60908

[51] Int. Cl.[6] ..... F02D 41/14; F02M 25/08

[52] U.S. Cl. ..... 123/674; 123/698

[58] Field of Search ..... 123/520, 674, 123/675, 698

[56] References Cited

U.S. PATENT DOCUMENTS

| | | | |
|---|---|---|---|
| 5,048,493 | 9/1991 | Orzel et al. | 123/674 |
| 5,090,388 | 2/1992 | Hamburg et al. | 123/674 |
| 5,245,978 | 9/1993 | Orzel | 123/674 |
| 5,257,613 | 11/1993 | Monda et al. | 123/674 |

FOREIGN PATENT DOCUMENTS

| | | |
|---|---|---|
| 62-174557 | 7/1987 | Japan . |
| 62-233466 | 10/1987 | Japan . |
| 63-111279 | 5/1988 | Japan . |
| 63-219863 | 9/1988 | Japan . |
| 2-245461 | 10/1990 | Japan . |
| 4-72453 | 3/1992 | Japan . |

*Primary Examiner*—Tony M. Argenbright
*Attorney, Agent, or Firm*—Kenyon & Kenyon

[57] ABSTRACT

Fuel-vapor evaporating from a fuel tank is led through a vapor pipe and absorbed in a charcoal canister. Fuel-vapor stored in the charcoal canister is supplied to an inlet pipe when a purge valve is opened when the engine is driven, because the pressure in the inlet pipe is low. Fuel-vapor is then burned as fuel in the engine. If the opening of the purge valve is suddenly increased at the start of the purge, the air fuel ratio control is disturbed. Therefore, the purge rate is gradually increased and the vapor concentration of the fuel-vapor purged from the charcoal canister is learned, and the change rate of the purge rate is made small because the air-fuel ratio control may be disturbed when the vapor concentration is not learned enough.

14 Claims, 17 Drawing Sheets

APPARATUS FOR DISPOSING OF FUEL VAPOR

BACKGROUND OF THE INVENTION

1. Field of the Invention

The present invention relates to an apparatus for disposing of fuel-vapor, especially to an apparatus, for disposing of fuel-vapor, which can control the air-fuel ratio of an exhaust gas within the proper range when a purge of fuel-vapor from a charcoal canister is initiated.

2. Description of the Related Arts

Fuel-vapor evaporated from a fuel tank is absorbed in a charcoal canister and is properly purged into an inlet pipe, as fuel, in order to improve fuel consumption and to avoid air pollution.

However, because the fuel-vapor purged from the charcoal canister disturbs the air-fuel control of an engine, a purge procedure which does not disturb the air-fuel control has been already proposed.

For example, in Unexamined Patent Publication (Kokai) No. 62-174557, a control apparatus for disposing of fuel-vapor which avoids exerting a harmful influence upon the air-fuel control by gradually opening or closing a purge valve at the beginning or the end of a purge operation, is disclosed.

Furthermore, in Unexamined Patent Publication (Kokai) No. 2-245461, a control apparatus for disposing of fuel-vapor which makes a valve opening speed slow, in accordance with a detected concentration of a purge gas, is disclosed.

As a degree of an influence which is exerted by a fuel-vapor purge is affected by the operating condition of the engine, it is unavoidable that the air-fuel ratio is affected by a purge if the opening or closing speed of a purge valve is kept constant.

Furthermore, because the concentration of a purge gas cannot be accurately detected at the start of a purge operation, an opening or closing speed of a purge valve cannot be accurately learned, and the air-fuel ratio may be affected by the fuel-vapor.

SUMMARY OF THE INVENTION

It is an object of the present invention to provide an apparatus for disposing of fuel-vapor which detects the vapor concentration in a purge gas when fuel-vapor is purged, and does not exert a harmful influence upon the air-fuel control when the purge rate is controlled.

According to the present invention, the purge rate, that is, the ratio of the fuel gas to the inlet air, is calculated and the changing rate of the purge rate is limited less than a predetermined threshold rate. The opening command for a purge valve determined in accordance with the purge rate is output when the driving condition of the engine allows a purge operation. A valve opening interval is calculated in order to control the air-fuel ratio detected by an air-fuel ratio sensor at a predetermined air-fuel ratio. The vapor concentration of the fuel-vapor purged into an inlet pipe is learned in accordance with the air-fuel ratio feedback factor. Furthermore, the change rate of the purge rate, the threshold rate of the changing rate of the purge rate or the purge rate is controlled so that the fluctuation of the air-fuel ratio caused by the purge is reduced.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENT

Figure 1:
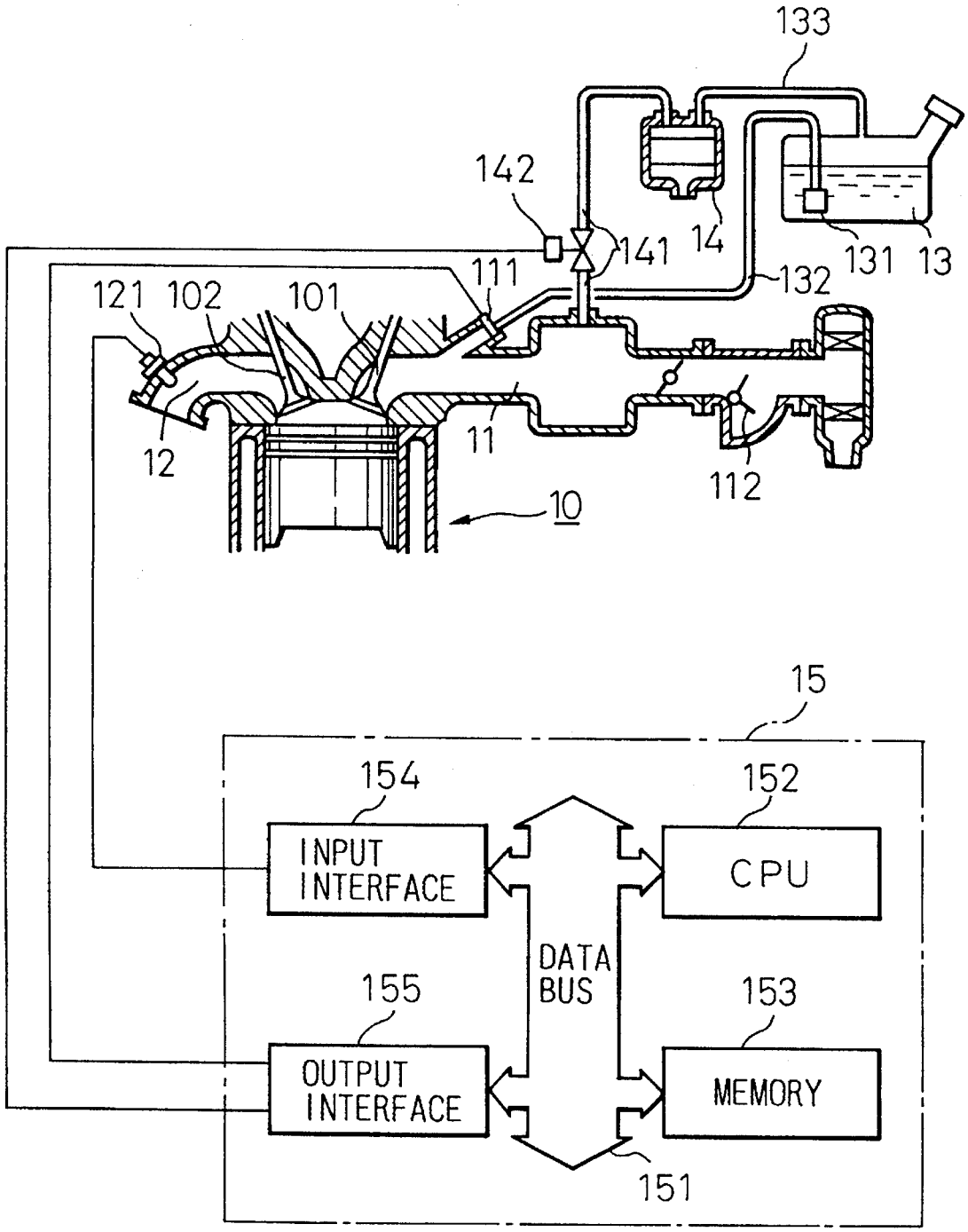
FIG. 1 is a schematic diagram of an apparatus for disposing of fuel-vapor according to the present invention.

FIG. 1 is a schematic diagram of the apparatus for disposing of fuel-vapor according to the present invention in which one cylinder 10 of the engine is connected to an inlet pipe 11 through an inlet valve 102 and to an exhaust pipe 12 through an exhaust valve 102.

The fuel injection valve 111 is arranged adjacent to the inlet valve on the inlet pipe 11.

Fuel stored in a fuel tank 13, and pressurized by a fuel pump 131 is supplied to the fuel injection valve 111 through a fuel pipe 132.

Fuel-vapor evaporating from the fuel tank 13 is led to a charcoal canister 14 through a vapor pipe 133.

The charcoal canister 14 is connected to the inlet pipe 11 by the purge pipe 141, and the purge valve 142 is installed on the purge pipe 141.

A air-fuel ratio sensor 121 which detects air-fuel ratio of the exhaust gas is installed on the exhaust pipe 12.

The apparatus for disposing of a fuel-vapor is controlled by the control system 15, and the control system is constructed as a microcomputer system.

That is, the control system 15 has a data-bus 151, a CPU 152, a memory 153, an input interface 154 and an output interface 155.

The air-fuel ratio sensor 121 is connected to the input interface 154, and the air-fuel ratio is detected by the control system.

The control system 15 controls the fuel injection valve 111 and the purge control valve 142 through the output interface 155.

According to the apparatus for disposing of fuel-vapor, the fuel-vapor evaporated from the fuel tank 13 is absorbed in the charcoal canister 14.

Because the pressure in the inlet pipe 11 is negative, fuel-vapor absorbed in the charcoal canister 14 is supplied to the inlet pipe 11 through the purge pipe 141 when the purge control valve 142 is opened, and is used as fuel by mixing with the fuel injected by the fuel injection valve 111.

On the other hand, the air-fuel ratio of the exhaust gas is detected by the air-fuel ratio sensor 121, and is used to determine the opening period of fuel injection valve 111 by the control system 15.

Namely, as the purge of the fuel-vapor disturbs the air-fuel control, it is necessary to purge the fuel-vapor as constantly as possible while the exhaust gas is clean.

Figure 2:
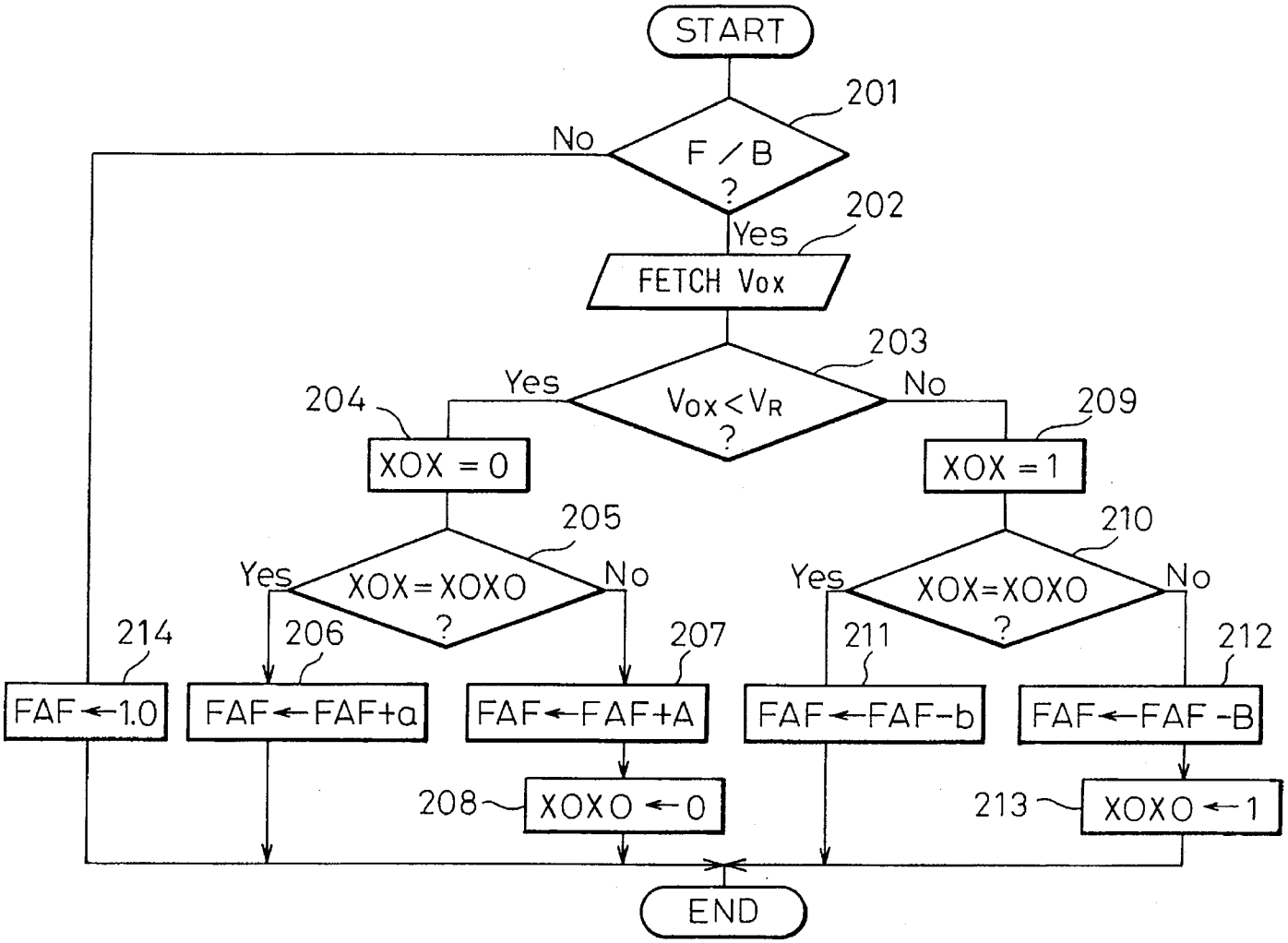
FIG. 2 is a flow-chart of the first air-fuel ratio control routine.

FIG. 2 is the flowchart of the first air-fuel control routine executed in the apparatus for disposing of fuel-vapor according to the first invention, and this routine is executed at every predetermined cam angle.

As step 201, it is determined whether or not the air-fuel control is allowable.

Namely, (1) The engine is not being started.

(2) The fuel is not being cut.

(3) The coolant temperature (THW)≧40° C.

(4) The air-fuel ratio sensor has been activated.

When all above-mentioned conditions are satisfied, the air-fuel ratio feedback control is allowed. However, if any one of the above-mentioned conditions is not satisfied, it is not allowed.

If the determination at step 201 is affirmative, the control proceeds to step 202, where the output voltage $V_{ox}$ of the air-fuel ratio sensor 121 is fetched. At step 203, it is determined whether or not the output voltage $V_{ox}$ is lower than the predetermined reference voltage $V_R$ (for example, 0.45 V).

If the determination at step 203 is affirmative, that is, if the air-fuel ratio of the exhaust gas is lean, the control proceeds to step 204, where the air-fuel ratio flag XOX is set to "0".

At step 205, it is determined whether or not the air-fuel ratio flag XOX is identical with the status keeping flag XOXO.

If the determination at step 205 is affirmative, that is, if the lean state continues, the control proceeds to step 206, where the air-fuel ratio correction factor FAF increases the lean integration constant "a", and this routine is terminated.

If the determination at step 205 is negative, that is, if the air-fuel ratio changes from the rich state to the lean state, control proceeds to step 207, where the air-fuel ratio correction factor FAF increases the lean skip constant "A".

Note, the lean skip constant "A" is set to a much larger value than is the lean integration constant "a".

At step 208, the status keeping flag XOXO is reset, and this routine is terminated.

If the determination at step 203 is negative, that is, if the air-fuel ratio of the exhaust gas is rich, the control proceeds to 209, where the air-fuel ratio flag XOX is set to "1".

At step 210, it is determined whether or not the air-fuel ratio flag XOX is identical with the status keeping flag XOXO.

If the determination at step 210 is affirmative, that is, if the rich state continues, control proceeds to step 211, where the air-fuel ratio correction factor FAF decreases the rich integration constant "b", and this routine is terminated.

If the determination at step 210 is negative, that is, the air-fuel ratio changes from the lean state to the rich state, control proceeds to step 212, where the air-fuel ratio correction factor FAF decreases the rich skip constant "B".

Note, the rich skip constant "B" is set as much larger value than the rich integration constant "b".

At step 213, the status keeping flag XOXO is set to "1", and this routine is terminated.

Note, when the determination at step 201 is negative, the control proceeds to step 214, where the air-fuel ratio correction factor FAF is set to "1", and this routine is terminated.

Figure 3:
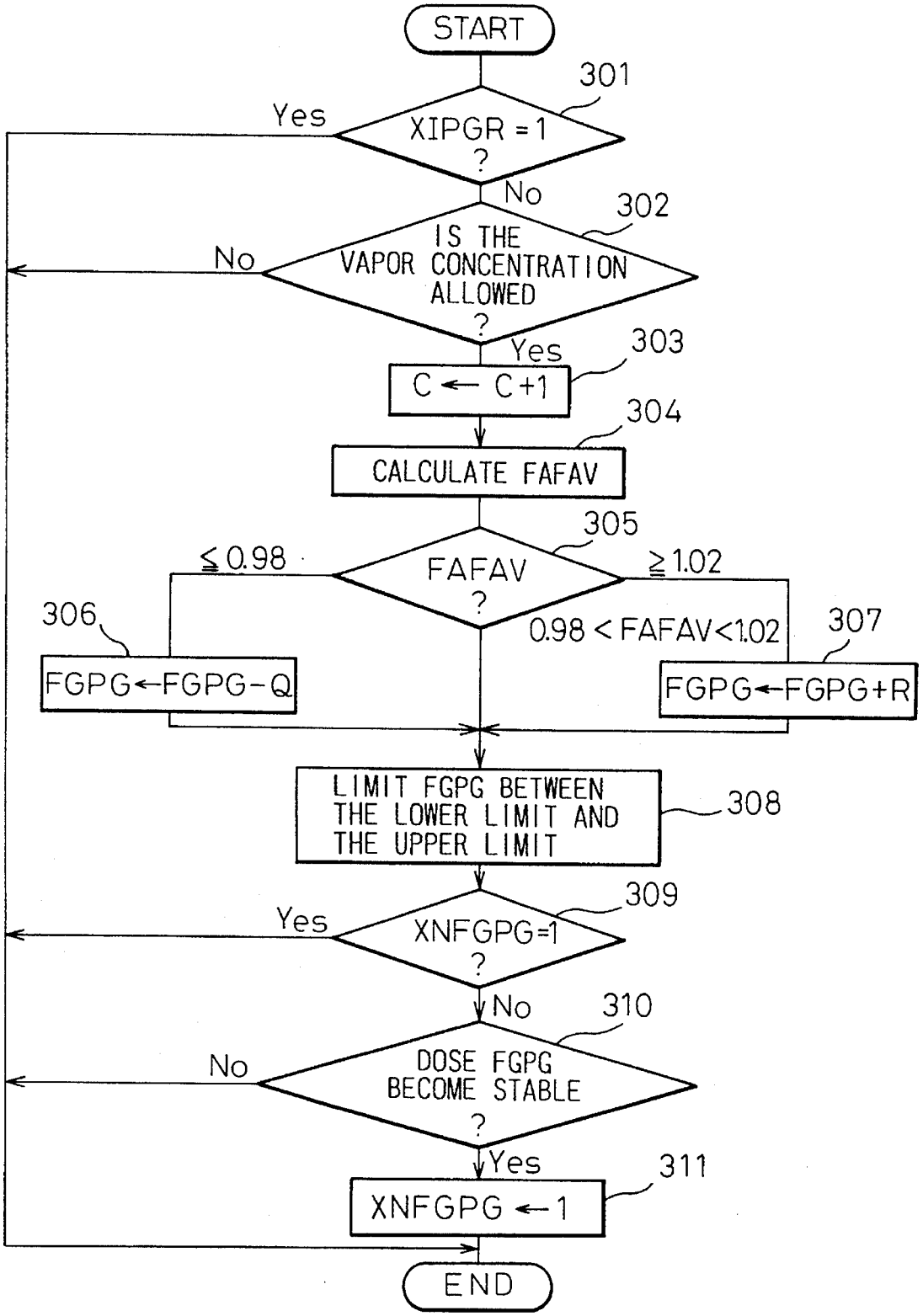
FIG. 3 is a flow-chart of the vapor concentration learning routine.

FIG. 3 is the flowchart of the vapor concentration learning routine which is executed in the apparatus for disposing of fuel-vapor according the first invention every predetermined time interval (for example 4 ms).

At step 301, it is determined whether or not the purge stopping flag XIPGR is "1", and if the determination is affirmative, that is, the purge is stopping, this routine is directly terminated.

If the determination at step 301 is negative, the control proceeds step 302, where it is determined whether or not the learning of the vapor, concentration is allowable.

(1) The air-fuel ratio feedback control is being executed.

(2) The coolant temperature≧80° C.

(3) The starting fuel increase amount=0

(4) The warming fuel increase amount=0

When all above-mentioned conditions are satisfied, the learning of the vapor concentration is allowed. However, if any one of the above-mentioned conditions is not satisfied, it is not allowed.

When the determination at step 302 is negative, that is, the learning of the vapor concentration is not allowed, this routine is directly terminated.

If the determination at step 301 is affirmative, that is, if the learning of the vapor concentration is allowed, the control proceeds to step 303, where the learning counter C is increased, and the control proceeds to step 304.

At step 304, the moving average FAFAV of the air-fuel ratio correction factor FAF is calculated, and the control proceeds to step 305.

At step 305, it is determined to which range, that is "smaller than a predetermined lower level (for example 0.98)", "larger than the predetermined lower level and smaller than a predetermined upper level (for example 1.02)" and "larger than the predetermined upper level", the moving average FAFAV belongs.

If the determination at step 305 is that the moving average FAFAV is smaller than 0.98, the control proceeds to step 306, where the vapor concentration index FGPG decreases the predetermined amount "Q" (for example 0.4%), and the control proceeds to step 308.

If the determination at step 305 is that the moving average FAFAV is larger than 1.02, the control proceeds to step 307, where the vapor concentration index FGPG increases by the predetermined amount "P" (for example 0.4%), and the control proceeds to step 308.

If the determination at step 305 is that the moving average FAFAV is larger than 0.98 and smaller than 1.02, the control directly proceeds to step 308 without renewing the vapor concentration index FGPG.

At step 308, the vapor concentration index FGPG is limited to within the low limit value "0.7" and the upper limit value "1.0", and the control proceeds to step 309.

At step 309, it is determined whether or not the learning completion flag XNFGPG is "1", that is, the learning of the vapor concentration index FGPG is completed, and if the determination is affirmative, this routine is directly terminated.

If the determination at step 309 is negative, the control proceeds to step 310, where it is determined whether or not the vapor concentration index FGPG has become stable.

If the determination at step 310 is negative, this routine is directly terminated, but if the determination at step 310 is affirmative, the control proceeds to step 311, where the learning completion flag XNFGPG is set to "1", and this routine is terminated.

Note, according to this routine, if the vapor concentration of the fuel-vapor purged into the inlet pipe 11 is "0", the vapor concentration index FGPG is set to "1", and the more the vapor concentration becomes rich, the more the vapor concentration index FGPG is set to smaller than "1".

Figure 4:
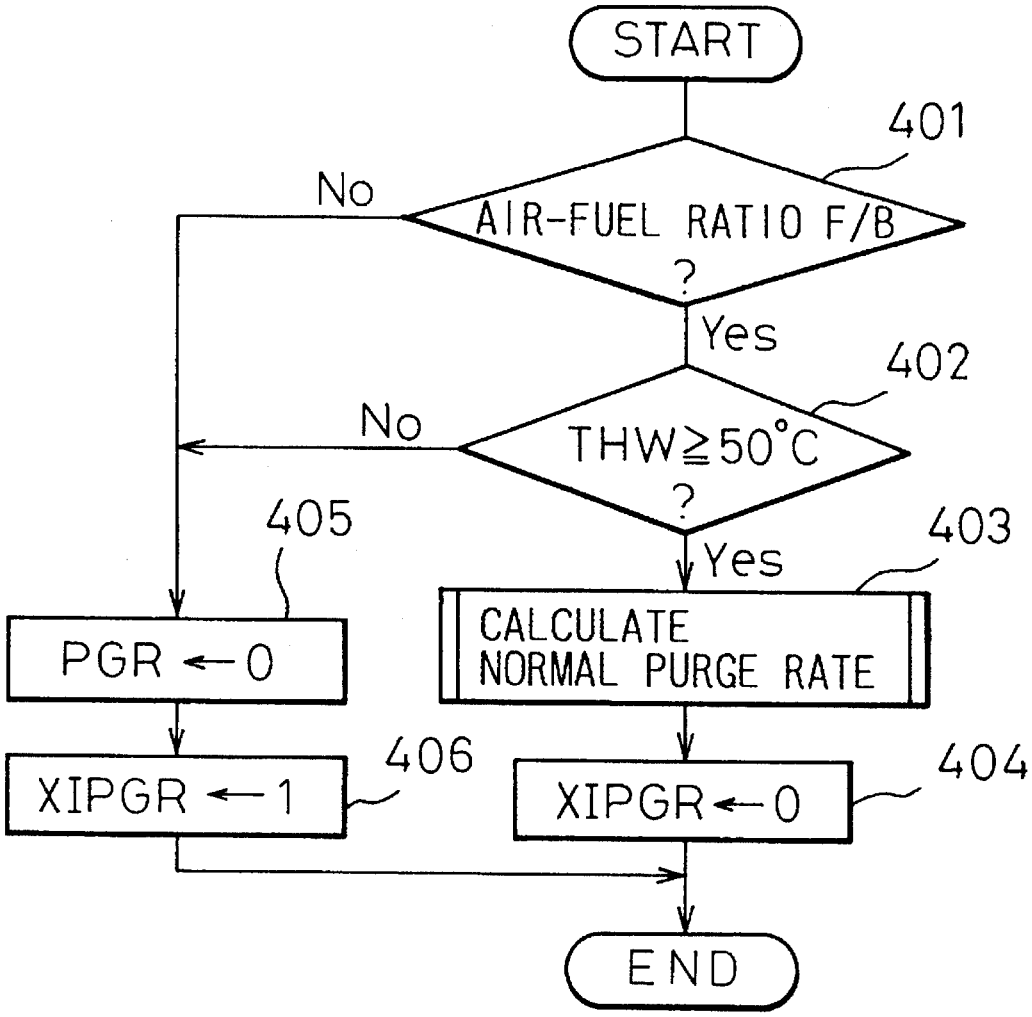
FIG. 4 is a flow-chart of the purge rate control routine.

FIG. 4 is the flowchart of the purge rate control routine executed in the apparatus for disposing of fuel-vapor according to the first invention, and it is determined whether or not the air-fuel feedback control is allowed at step 401.

If the determination at step 401 is affirmative, the control proceeds to step 402, where it is determined whether or not the coolant temperature THW is higher than 50° C.

If the determination at step 402 is affirmative, the control proceeds to step 403, where the normal purge rate control is executed, and this routine is terminated after the purge stopping flag XIPGR is reset at step 404.

If the determination at step 401 or 402 is negative, the control proceeds to step 405, where the purge rate PGR is reset, and this routine is terminated after the purge stopping flag XIPGR is set to "1" at step 406.

Figure 5:
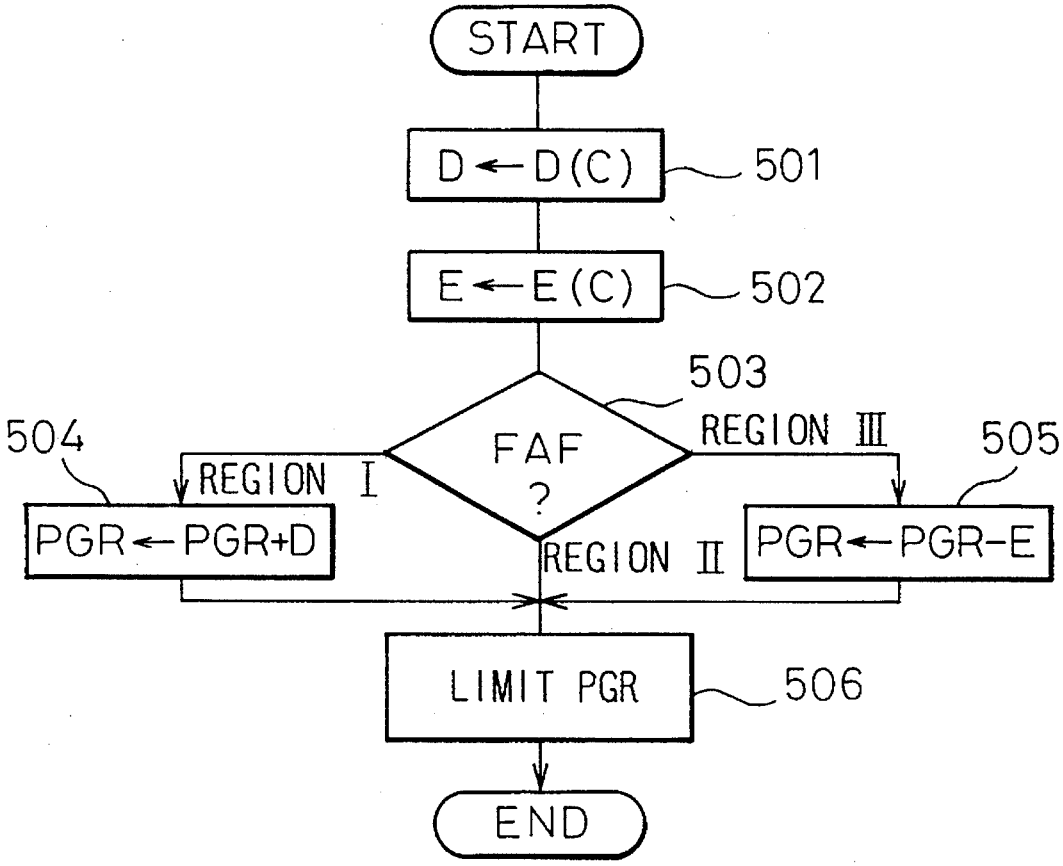
FIG. 5 is a flow-chart of the first normal purge rate calculating routine.

FIG. 5 is the flowchart of the first normal purge rate control which is executed at step 403 of the purge rate control routine shown in FIG. 4. At step 501, the purge increasing amount D is calculated as the function of the learning counter C which is determined at step 303 of the vapor concentration learning routine shown at FIG. 3.

At step 502, the purge decreasing amount E is also calculated as the function of the learning counter C.

Figure 6:
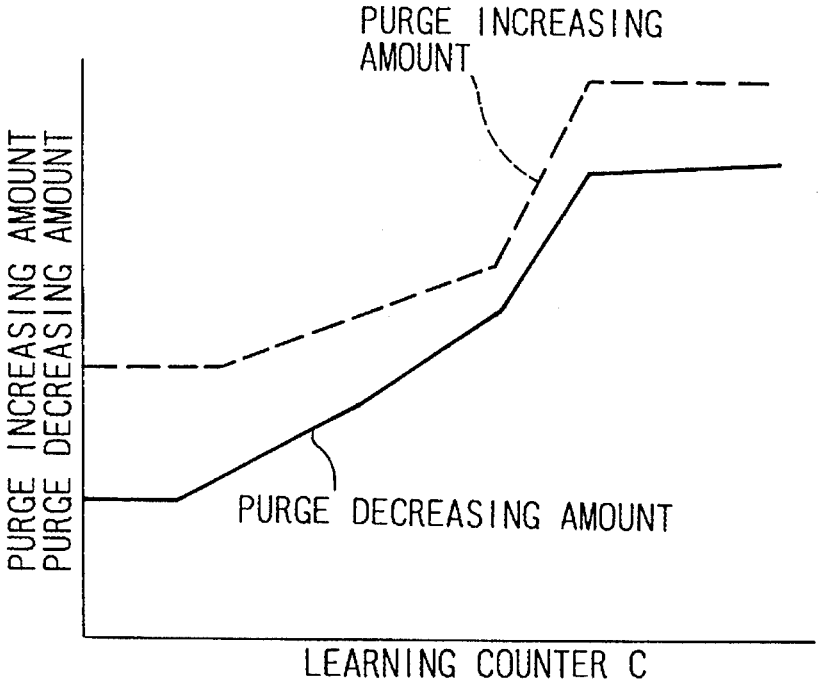
FIG. 6 is a graph for determining the increasing and the decreasing amount of the purge rate.

FIG. 6 is the graph to determine the purge increasing amount D and the purge decreasing amount E, and the ordinate shows the purge increasing amount D or the purge decreasing amount E and the abscissa shows the value of the learning counter C.

Namely, the purge increasing amount D and the purge decreasing amount E are set large in proportion to the learning counter C.

At step 503, it is determined to which region the air-fuel ratio correction factor belongs.

Figure 7:
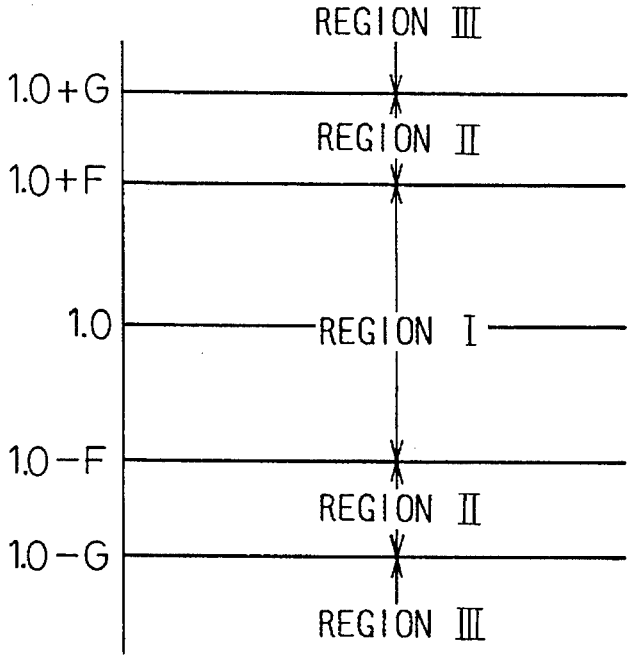
FIG. 7 is a graph for showing the domain of the air-fuel ratio correction factor for air-fuel ratio.

FIG. 7 is the graph showing the regions of the air-fuel ratio correction factor, and it is determined that it belongs to the region "I" if it is within 1±F, it belongs to the region "II" if it is between 1±F and 1±G, and it belongs to the region "III" if it is outside 1±G. Note, 0<F <G.

If the determination at 503 is that the air-fuel ratio correction factor belongs to the region "I", the control proceeds to step 504, where the purge rate PGR increases by the purge increasing amount D, and the control proceeds to step 506.

If the determination at 503 is that it belongs to the region "II", the control directly proceeds to step 506.

At step 506, the purge rate PGR is limited to the low limit and the upper limit, and this routine is terminated.

Figure 8:
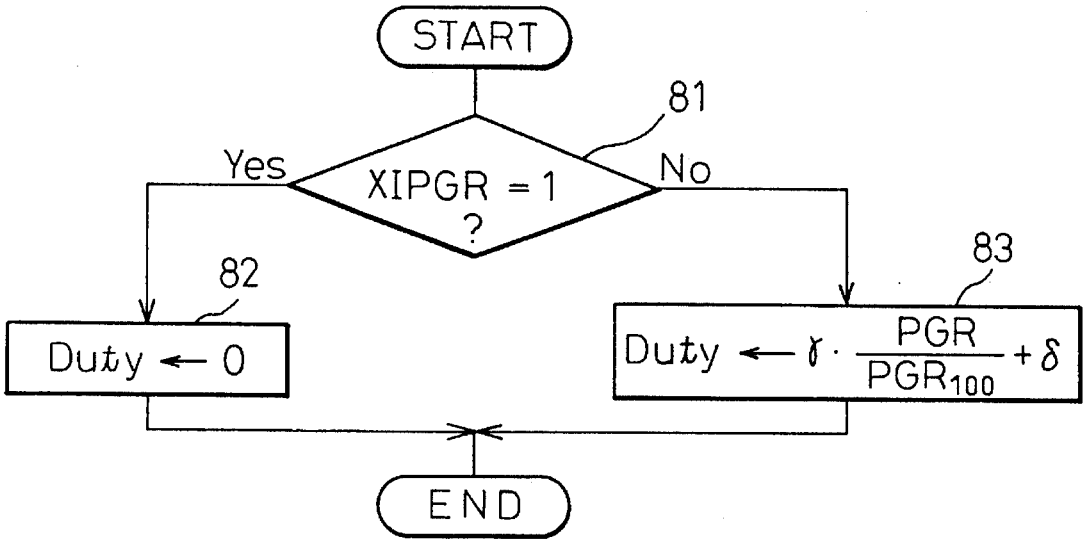
FIG. 8 is a flow-chart of the first purge valve control routine.

FIG. 8 is the flowchart of the purge control valve driving routine, and the opening of the purge control valve 142 is controlled according to the duty ratio control.

At step 81, it is determined whether or not the purge stopping flag XIPGR is "1", and if the determination is affirmative, that is, the purge is stopping, this routine finishes after the duty ratio Duty is set to "0" at step 82.

If the determination at step 81 is negative, that is, the purge is continuing, the control proceeds to step 83, where the duty ratio Duty is calculated from the following equation.

$$\text{Duty}=\gamma\cdot PGR/PGR_{100}+\delta$$

Where $PGR_{100}$ is the purge rate at full opening of the purge control valve, and it is previously determined as the function of the engine speed Ne and the engine load (for example the inlet-air amount GN detected by the air-flow meter).

$\gamma$ and $\delta$ are the correction coefficients according to the battery voltage and the atmospheric pressure respectively.

Figure 9:
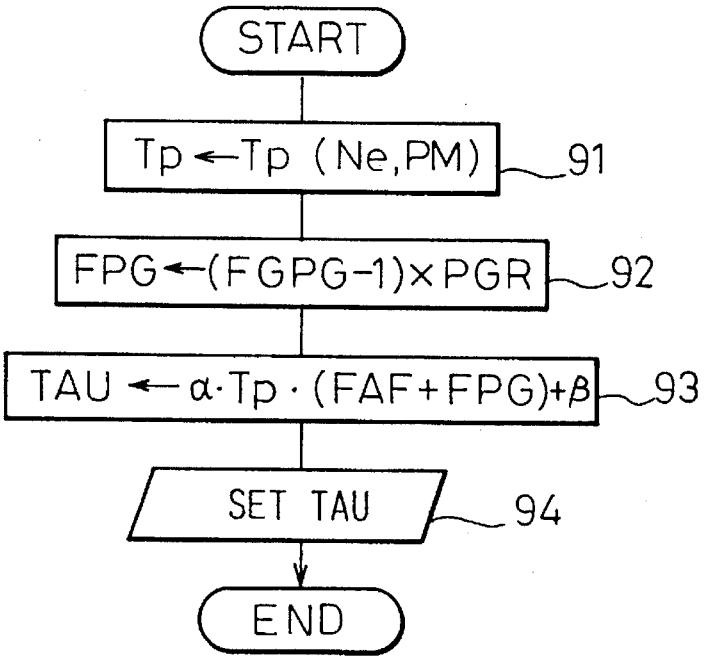
FIG. 9 is a flow-chart of the fuel injecting routine.

FIG. 9 is the flowchart of the fuel injection valve control routine executed in the apparatus for disposing of fuel-vapor according to the first invention, and the basic fuel injection valve opening interval is calculated as the function of the engine speed Ne and the inlet pressure PM at step 91.

At step 92, the purge correction factor FPG is calculated based on the vapor concentration index FGPG calculated in the vapor concentration learning routine shown in FIG. 3 and the purge rate PGR calculated in the first normal purge rate control shown in FIG. 5.

At step 93, the fuel injection valve opening interval TAU is calculated based on the air-fuel ratio correction factor FAF calculated in the air-fuel ratio control routine shown in FIG. 2 and the purge correction coefficient FPG calculated at step 92 according to the following equation.

$$TAU=\alpha\cdot Tp\cdot(FAF+FPG)+\beta$$

Where, $\alpha$ and $\beta$ are the correction coefficients based on the starting fuel increasing amount and the warming fuel increasing amount, etc.

At step 94, the fuel injection valve opening interval TAU is output, and this routine is terminated.

Namely, in the first invention, the rate of change of the purge rate is limited within the narrow range, because there is the possibility of the disturbance of the air-fuel ratio control occurred by the change of the purge rate when the learning of the vapor concentration is not enough, that is, the value of the vapor concentration learning counter is small.

By the apparatus for disposing of fuel-vapor according to the first invention, the fluctuation of the air-fuel ratio caused by the purge can be reduced, because the change rate of the purge rate is made small with less learning of the vapor concentration.

Figure 10:
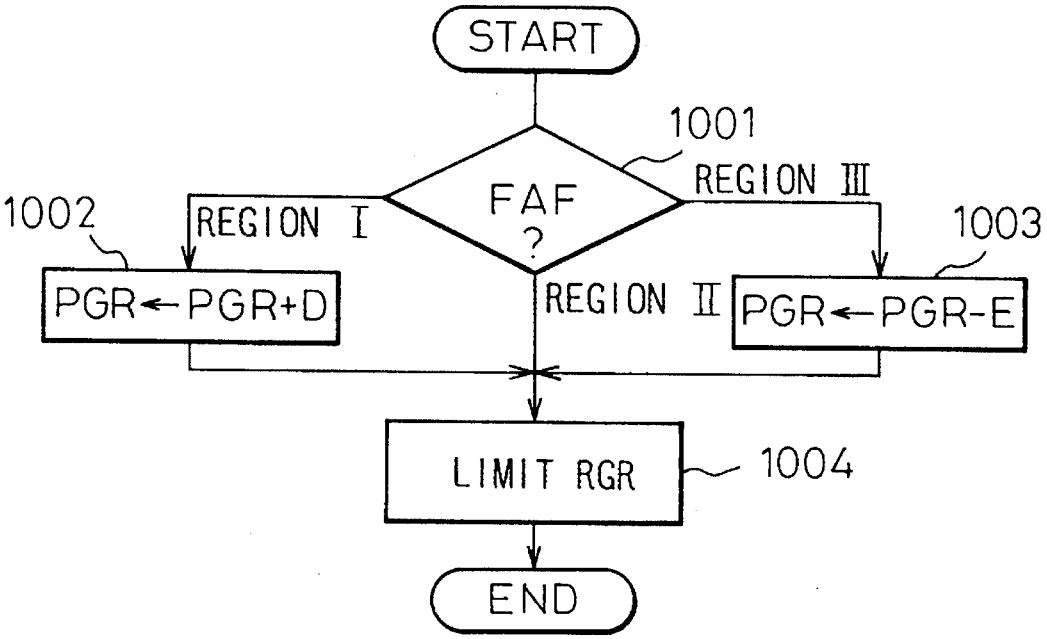
FIG. 10 is a flow-chart of the second normal purge rate calculating routine.
Figure 11:
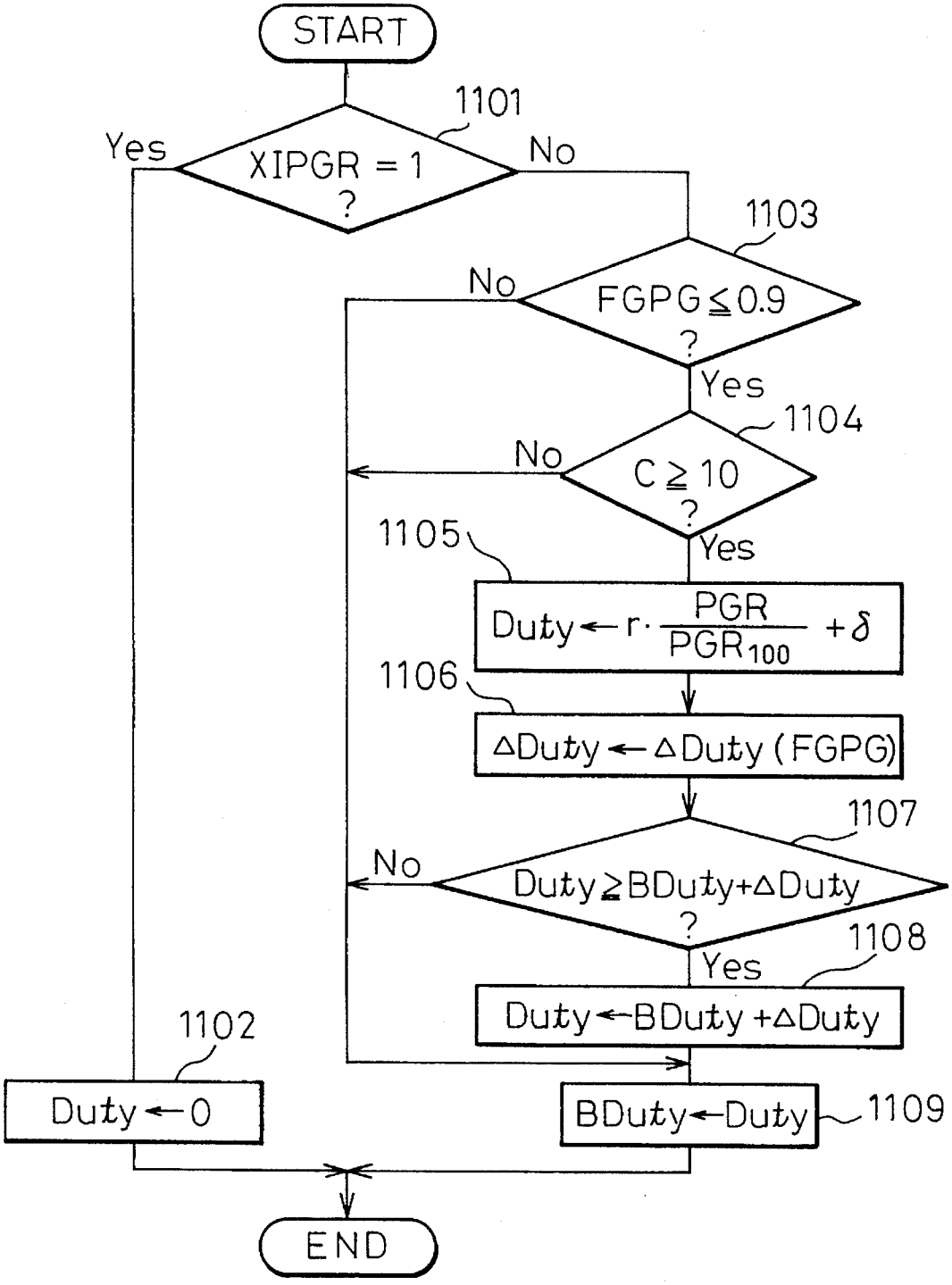
FIG. 11 is a flow-chart of the second purge valve control routine.

FIGS. 10 and 11 are the flowcharts of the second normal purge rate control routine used in the second invention instead of the first one and the second purge valve control routine used instead of the first one.

Note, the other routines are same as the first invention.

Namely, in the second invention, the rate of change of the purge valve opening is limited within the narrow range when the learning of the vapor concentration is not enough.

The second normal purge rate control routine shown in FIG. 10 is the routine which deletes step 501 and 502 from the first normal purge rate control routine shown in FIG. 5, and the purge rate increasing amount D and the purge rate decreasing amount E are given as constants.

Namely, at step 1001, it is determined to which region the air-fuel ratio correction factor FAF belongs.

At step 1001, if the air-fuel ratio correction factor FAF belongs to region I, the control proceeds to step 1002, where the purge rate PGR increases by the purge rate increasing amount D, and the control proceeds to step 1004.

At step 1001, if the air-fuel ratio correction factor FAF belongs to region III, the control proceeds to step 1003, where the purge rate PGR decreases by the purge rate decreasing amount E, and the control proceeds to step 1004.

At step 1001, if the air-fuel ratio correction factor FAF belongs to region II, the control directly proceeds to step 1004.

At step 1004, the purge rate is limited to between the low limit value and the upper limit value, and this routine is terminated.

At step 1101 in the second purge valve control routine, it is determined whether or not the purge stopping flag XIPGR is "1", and if the determination is affirmative, that is, if the purge is stopping, this routine is terminated after the duty ratio Duty is set to "0" at step 1102.

If the determination at step 1101 is negative, that is, if the purge is continuing, the control proceeds to step 1103, where it is determined whether or not the vapor concentration index FGPG is smaller than the predetermined threshold value (for example 0.9), and the control proceeds to step 1104 if the determination is affirmative.

At step 1104, it is determined whether or not the value of the learning counter is larger than the predetermined value (for example 10), that is, the learning is enough.

If the determination at step 1104 is affirmative, the control proceeds to step 1105, where the duty ratio Duty is calculated according to the following equation.

$$\text{Duty}=\gamma\cdot PGR/PGR_{100}+\delta$$

Where $PGR_{100}$ is the purge rate at full opening of the purge control valve, and it is previously determined as the function of the engine speed Ne and the engine load (for example the inlet-air amount GN detected by the air-flow meter).

And $\gamma$ and $\delta$ are the correction coefficients according to the battery voltage and the atmospheric pressure, respectively.

At step 1106, the duty ratio correction amount $\Delta$Duty is calculated as the function of the vapor concentration index FGPG.

Figure 12:
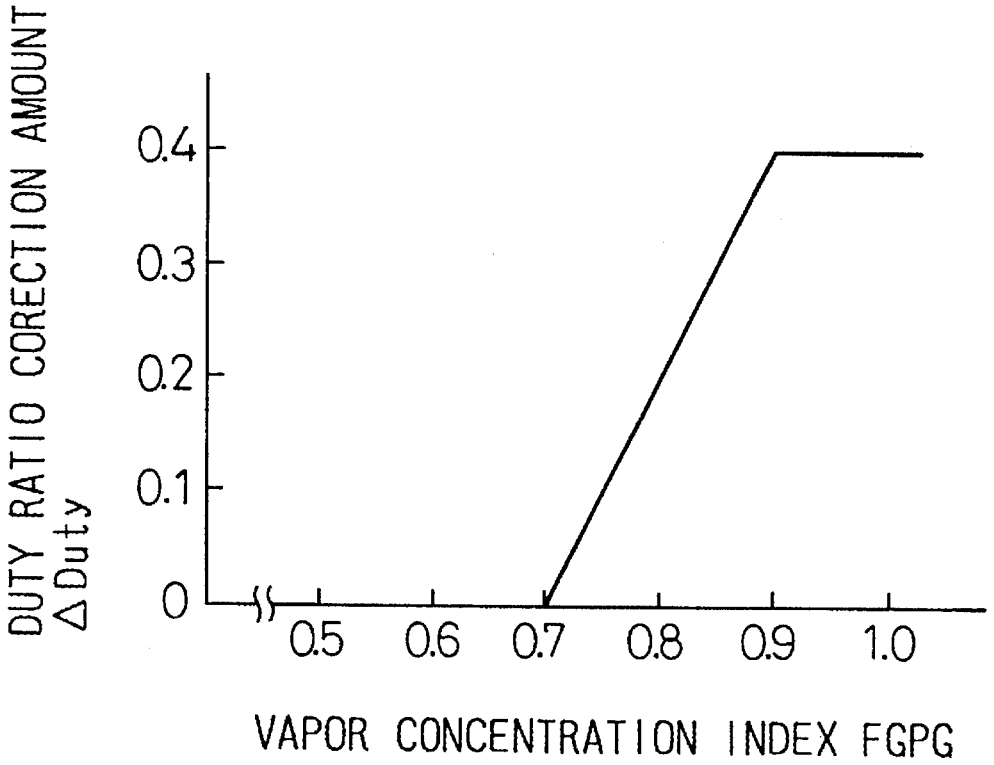
FIG. 12 is a graph for determining the compensating value for duty ratio.

FIG. 12 is the graph to determine the duty ratio correction amount $\Delta$Duty, and the ordinate shows the duty ratio correction amount $\Delta$Duty and the abscissa shows the vapor concentration index FGPG.

Namely, the greater the vapor concentration, that is, the lower the amount of the fuel in the fuel-vapor the higher the duty ratio correction amount $\Delta$Duty is set.

At step 1107, it is determined whether or not the sum of the old duty ratio BDuty, which was calculated at the last execution, and the duty ratio correction amount $\Delta$Duty are larger than the duty ratio Duty which is calculated at the present execution, and the control proceeds to step 1108 if the determination is affirmative.

At step 1108, the duty ratio Duty is set to the sum of the old duty ratio BDuty which was calculated at the last execution and the duty ratio correction amount ADuty, and this routine is terminated after the old duty ratio BDuty, which was calculated at the last execution, is set to the duty ratio Duty.

After the determination at any one of steps 1103, 1104 and 1107, the control directly proceeds to step 1109.

By using the apparatus for disposing of fuel-vapor according to the second invention, the fluctuation in the air-fuel ratio caused by the purging can be reduced, because the less the vapor concentration is learned, the smaller change rate of the opening of the purge valve becomes.

Figure 13:
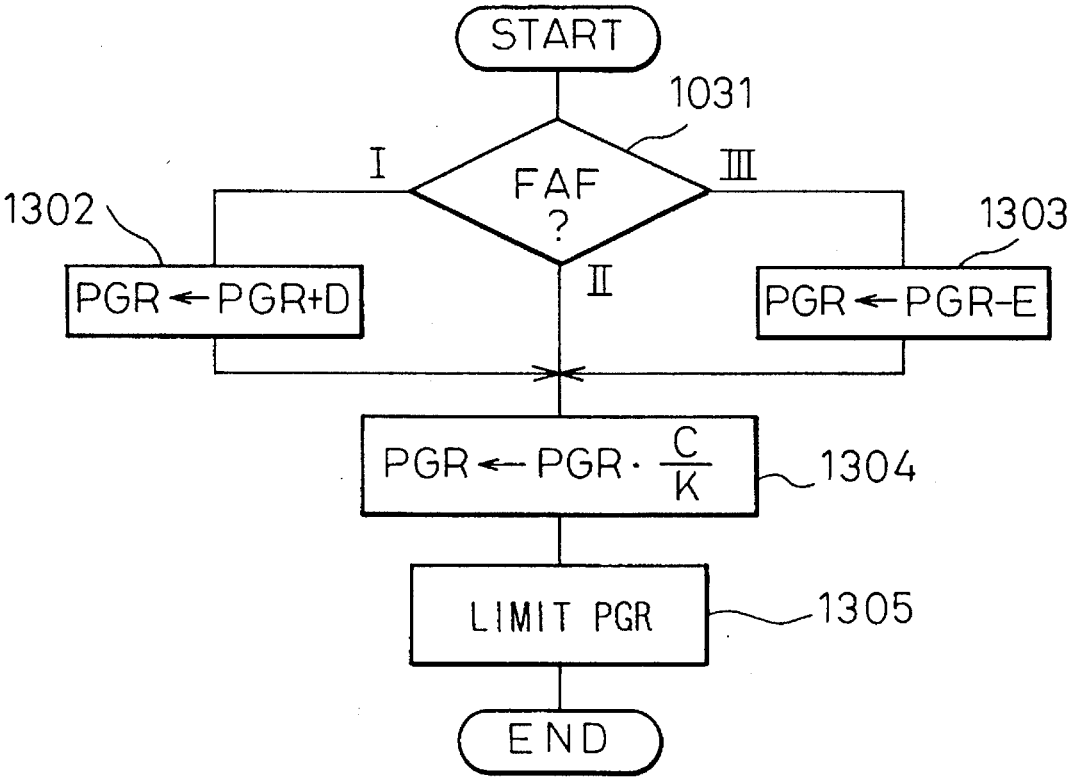
FIG. 13 is a flow-chart of the third normal purge rate calculating routine.

FIG. 13 is the flowchart of the third normal purge rate control routine used in the third invention instead of the first normal purge rate control routine.

Note, the other routines are same as the first invention.

Namely, the third invention restrains the change rate of the air-fuel ratio corrected by the correction factor which closes to "1" in proportion to the learning of the vapor concentration.

At step 1301, it is determined to which region the air-fuel ratio correction factor belongs.

If the determination at step 1301 is that the air-fuel ratio correction factor FAF belongs to region I, the control proceeds to step 1302, where the purge rate PGR increases the purge rate increasing amount D, and the control proceeds to step 1304.

If the determination at step 1301 is that the air-fuel ratio correction factor FAF belongs to region III, the control proceeds to step 1303, where the purge rate PGR decreases the purge rate decreasing amount E, and the control proceeds to step 1304.

If the determination at step 1301 is that the air-fuel ratio correction factor FAF belongs to region II, the control directly proceeds to step 1304.

Note, the purge rate increasing amount D and the purge rate decreasing amount E are given as constants.

At step 1304, the purge rate PGR is corrected according to the following equation.

$$PGR=PGR\cdot(C/K)$$

Where C is the value of the learning counter increased in the vapor concentration learning routine, and K is constant (for example 10).

Namely, the correction amount for the purge rate PGR is decreased in accordance with increasing of the learning counter.

At step 1305, the purge rate is limited between the low limit value and the upper limit value, and this routine is terminated.

Using the apparatus for disposing of fuel-vapor according to the third invention, the fluctuation in the air-fuel ratio caused by the purge can be reduced, because the purge rate is made small by the correction, when the vapor concentration is not learned enough.

Figure 14:
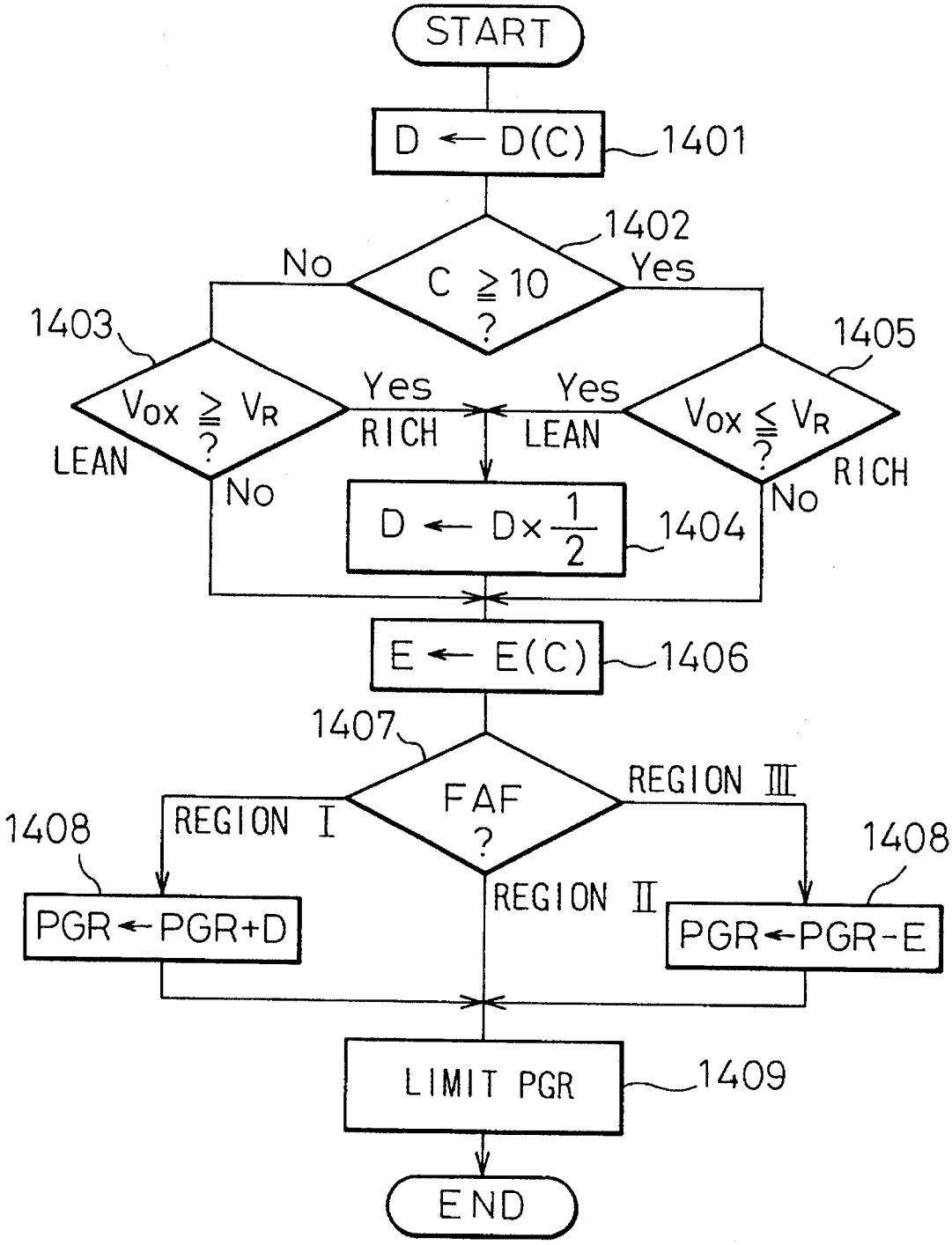
FIG. 14 is a flow-chart of the fourth normal purge rate calculating routine.

FIG. 14 is the flowchart of the fourth normal purge rate control routine used, instead of the first one in the fourth invention.

Note, the other routines are same as in the first invention.

At step 1401, the purge rate increasing amount D is calculated as the function of the number of the learning counter which is determined at step 303 of the vapor concentration learning routine shown in FIG. 3.

At step 1402, it is determined whether or not the value of the learning counter is larger than the predetermined value (for example 10).

If the determination at step 1402 is negative, the control proceeds to step 1403, where it is determined whether or not the output of the air-fuel ratio sensor 121 is larger than the threshold voltage $V_R$, that is, whether or not the air-fuel ratio of the exhaust gas is rich.

If the determination at step 1403 is affirmative, the control proceeds to step 1403, where the purge rate increasing amount D is multiplied by a predetermined positive number which is smaller than 1.0 (for example 0.5).

Namely, the small number in the learning counter means that the fuel is excessively supplied when the purge rate is increased, because the purge does not advance, a large amount of fuel is absorbed in the charcoal canister 14, and the vapor concentration of the purge gas is high. As a result the air-fuel ratio correction factor correction factor FAF is corrected to the lean side, the purge rate is again increased and the air-fuel ratio correction factor FAF is again corrected to the lean side. The purge rate increasing amount D is made small in order to avoid a large shift of the air-fuel ratio correction factor FAF to the lean side by this positive feedback.

If the determination at 1402 is affirmative, the control proceeds to step 1405, where it is determined whether or not the output of the air-fuel ratio sensor 121 $V_{ox}$ is smaller than the threshold voltage $V_R$, that is, whether or not the air-fuel ratio of the exhaust gas is lean.

If the determination at 1405 is affirmative, the control proceeds to step 1404, where the purge rate increasing amount D is multiplied by a predetermined positive number which is smaller than 1.0 (for example 0.5).

Namely, the large number in the learning counter means that air is excessively supplied when the purge rate is decreased because the purge advances enough, a small amount of fuel is left in the charcoal canister 14, and the vapor concentration of the purge gas is low. As a result the air-fuel ratio correction factor FAF is corrected to the rich side, the purge rate is again decreased and the air-fuel ratio correction factor FAF is again corrected to the rich side. The purge rate increasing amount D is made small in order to avoid a large shift of the air-fuel ratio correction factor FAF to the rich side by this positive feedback.

If the determinations at 1403 and 1405 are negative, the control directly proceeds to step 1406.

At step 1406, the purge rate decreasing amount E is determined as the function of the number of the learning counter C.

At step 1407, it is determined to which region the air-fuel ratio correction factor FAF belongs.

If the air-fuel ratio correction factor FAF belongs in region I at step 1407, the control proceeds to step 1408, where the purge rate PGR increases by the purge rate increasing amount D, and the control proceeds to step 1409.

If the air-fuel ratio correction factor FAF belongs in region III at step 1407, the control proceeds to step 1408, where the purge rate PGR decreases by the purge rate decreasing amount E, and the control proceeds to step 1409.

If the air-fuel ratio correction factor FAF belongs in region II at step 1407, the control directly proceeds to step 1409.

At step 1409, the purge rate is limited between the low limit value and the upper limit value, and this routine is terminated.

By using the apparatus for disposing of fuel-vapor according to the forth invention, a fluctuation of the air-fuel ratio caused by the purge can be reduced because the purge rate is made small when the air-fuel ratio is rich and the vapor concentration is less learned, or when the air-fuel ratio is lean and the vapor concentration is learned enough.

Figure 15:
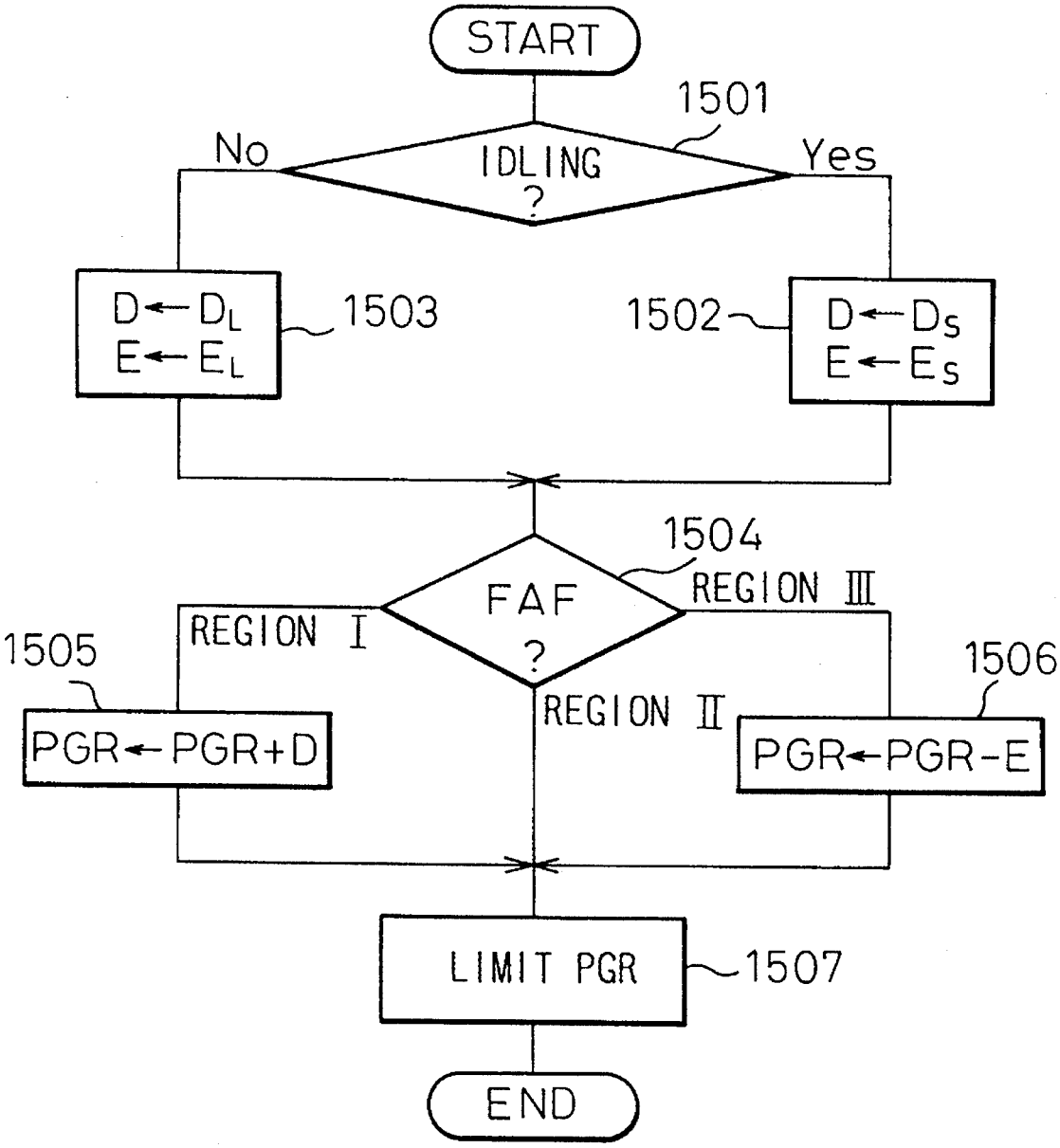
FIG. 15 is a flow-chart of the fifth normal purge rate calculating routine.

FIG. 15 is the flowchart of the fifth normal purge rate control routine used, instead of the first one, in the fourth invention.

It is determined whether or not the engine is in the idling operation at step 1501, and if the determination is affirmative, the control proceeds to step 1502.

At step 1502, the purge rate increasing amount D is set to $D_S$ and the purge rate decreasing amount E is set to $E_S$.

If the determination at 1501 is negative, the control proceeds to step 1503, where the purge rate increasing amount D is set to $D_L$ and the purge rate decreasing amount E is set to $E_L$.

Note, $D_S > D_L$, $E_S > E_L$

Namely, the change in the purge rate disturbs the air-fuel ratio control, and the purge rate increasing amount D and the purge rate decreasing amount E are set low because both the renewal rate of the air-fuel ratio correction factor and the convergence of the air-fuel ratio correction factor are slow. On the other hand, the purge rate increasing amount D and the purge rate decreasing amount E is set high because both the renewal rate of the air-fuel ratio correction factor and the convergence of the air-fuel ratio correction factor are fast.

At step 1504, it is determined in which region the air-fuel ratio correction factor FAF belongs.

If the air-fuel ratio correction factor FAF belongs in region I at step 1504, the control proceeds to step 1505, where the purge rate PGR increases the purge rate increasing amount D, and the control proceeds to step 1507.

If the air-fuel ratio correction factor FAF belongs to region III at step 1504, the control proceeds to step 1506, where the purge rate PGR decreases the purge rate decreasing amount E, and the control proceeds to step 1507.

If the air-fuel ratio correction factor FAF belongs to region II at step 1504, the control directly proceeds to step 1507.

At step 1507, the purge rate is limited between the low limit value and the upper limit value, and this routine is terminated.

By the apparatus for disposing the fuel-vapor according to the seventh invention, the fluctuation of the air-fuel ratio occurred by the purge can be reduced, because the more renewal speed of the air-fuel ratio correction factor FAF is slow, the more the change rate of the purge rate is made small.

Figure 16:
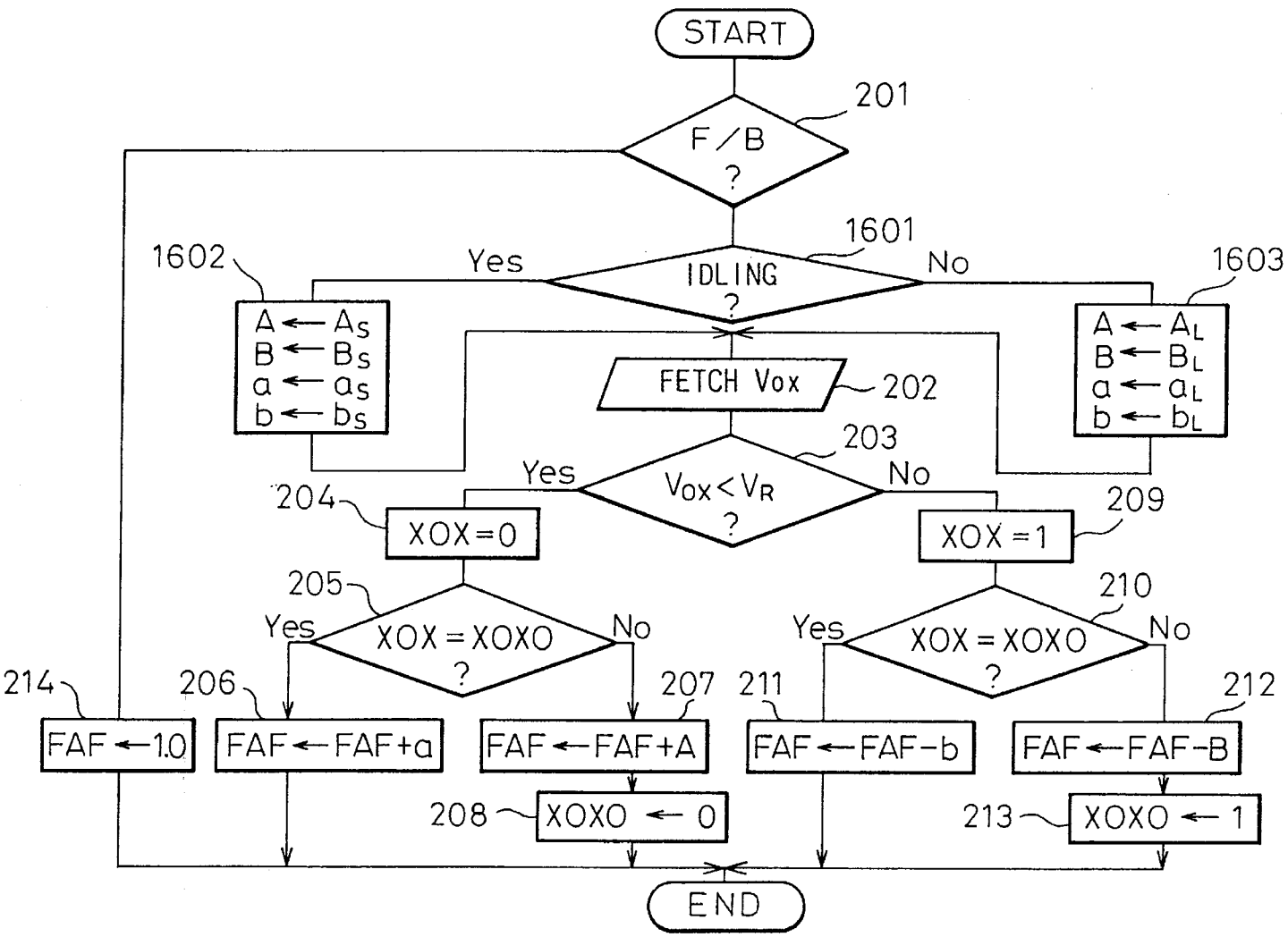
FIG. 16 is a flow-chart of the second air-fuel ratio control routine.

FIG. 16 is the flowchart of the second air-fuel ratio control routine used in the fifth invention, and steps 1601–1603 are inserted between step 201 and 202 of the first air-fuel ratio control routine shown in FIG. 2.

At step 201, it is determined whether or not the air-fuel ratio control is allowable.

Namely, (1) The engine is not starting.

(2) The fuel is not being cut.

(3) The coolant temperature (THW)≧40° C.

(4) The air-fuel ratio sensor has been activated.

When all above-mentioned conditions are satisfied, the air-fuel ratio feedback control is allowed. However, if any one of the above-mentioned conditions is not satisfied, it is not allowed.

If the determination at 201 is affirmative, the control proceeds to step 1601, where it is determined whether or not the engine is idling.

If the determination at 1601 is affirmative, the control proceeds to step 1602, where the following process is executed.

The lean skip amount A is set to the lean skip correction amount at idling operation $A_S$.

The rich skip amount B is set to the rich skip correction amount at idling operation $B_S$.

The lean integral amount a is set to the lean integral correction amount at idling operation $a_S$.

The rich integral amount b is set to the rich integral correction amount at idling operation $b_S$.

If the determination at 1601 is negative, the control proceeds to step 1603, where the following process is executed.

The lean skip amount A is set to the lean skip correction amount at non-idling operation $A_L$.

The rich skip amount B is set to the rich skip correction amount at non-idling operation $B_L$.

The lean integral amount a is set to the lean integral correction amount at non-idling operation $a_L$.

The rich integral amount b is set to the rich integral correction amount at non-idling operation $b_L$.

Note, $A_L>A_S$, $B_L>B_S$, $a_L>a_S$, $b_L>b_S$

Namely, the skip correction amount and the integral correction amount at idling operation are set to be smaller than those at non-idling operation in order that the speed of the air-fuel ratio control is made slow.

At step 202, the output voltage of the air-fuel ratio sensor 121 $V_{ox}$ is fetched, and it is determined whether or not the output voltage $V_{ox}$ is smaller than the predetermined voltage $V_R$ (for example, 0.45 V) at step 203.

If the determination at step 203 is affirmative, that is, the air-fuel ratio of the exhaust gas is lean, the control proceeds to the step 204, where the air-fuel ratio flag XOX is set to "0".

At step 205, it is determined whether or not the air-fuel ratio flag XOX is identical with the status storing flag XOXO.

If the determination at step 205 is affirmative, that is, the lean state is continuing, the control proceeds to step 206, where the air-fuel ratio correction factor FAF increases the lean integration amount "a", and this routine is terminated.

If the determination at step 205 is negative, that is, the air-fuel ratio is turned from the rich state to the lean state, the control proceeds to step 207, where the air-fuel ratio correction factor FAF increases by the lean skip amount "A".

Note, the lean skip amount "A" is set much larger than the lean integration amount "a".

At step 208, the status keeping flag XOXO is reset, and this routine is terminated.

If the determination at step 203 is negative, that is, that the air-fuel ratio on the exhaust gas is rich, the control proceeds to 209, where the air-fuel ratio flag XOX is set to "1".

At step 210, it is determined whether or not the air-fuel ratio flag XOX is identical with the status storing flag XOXO.

If the determination at step 210 is affirmative, that is, the rich state is continuing, the control proceeds to step 211, where the air-fuel ratio correction factor FAF decreases by the rich integration amount "b", and this routine is terminated.

If the determination at step 210 is negative, that is, the air-fuel ratio is turned from the lean state to the rich state, the control proceeds to step 212, where the air-fuel ratio correction factor FAF decreases by the rich skip amount "B".

Note, the rich skip amount "B" is set to a much larger value than the rich integration amount "b".

At step 213, the status keeping flag XOXO is set to "1", and this routine is terminated.

Note, when the determination at step 201 is negative, the control proceeds to step 214, where the air-fuel ratio correction factor FAF is set to "1", and this routine is terminated.

Note, the other routines are same as the first invention.

Figure 17:
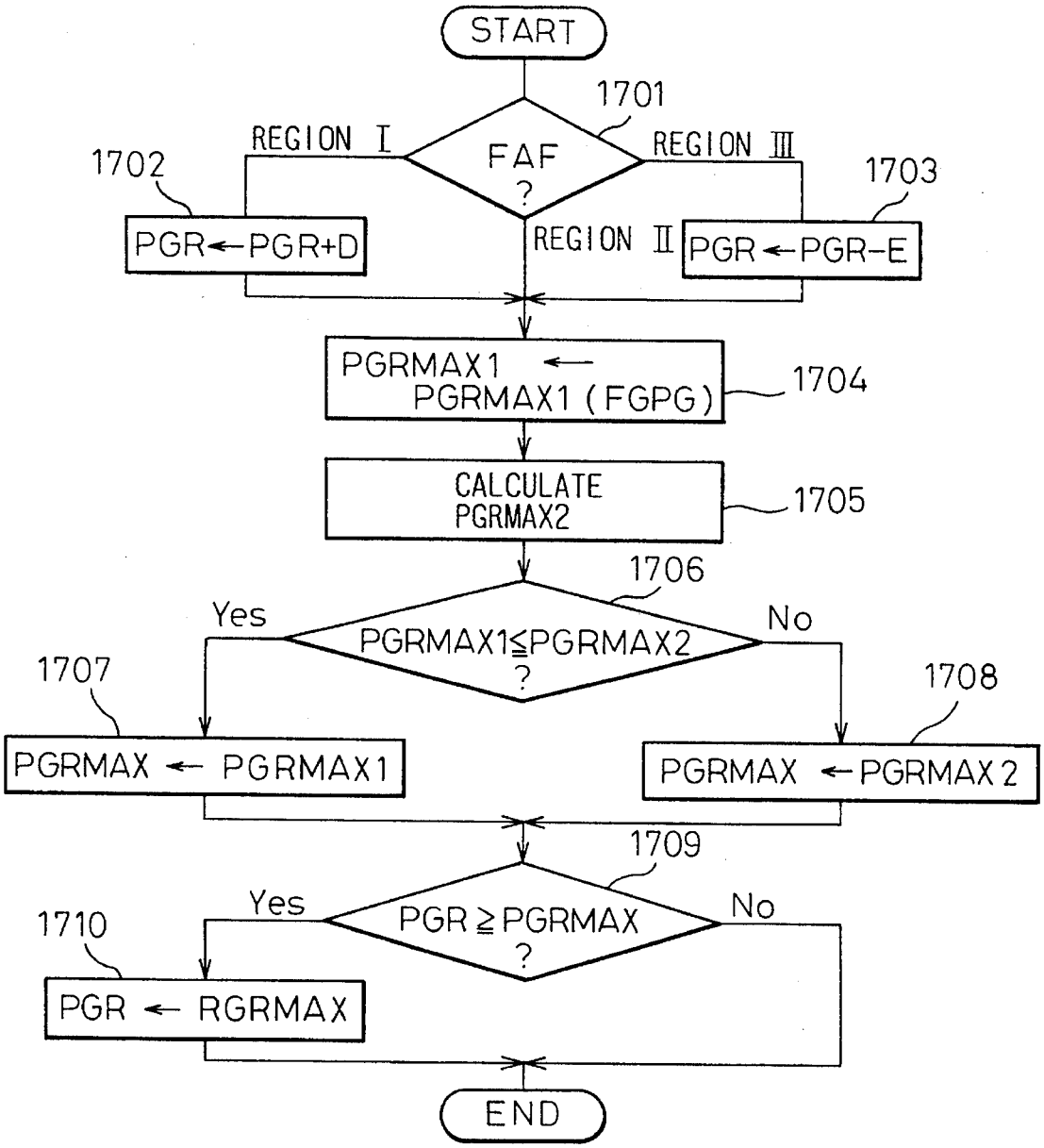
FIG. 17 is a flow-chart of the sixth normal purge rate calculating routine.

FIG. 17 is the flowchart of the sixth normal purge rate control routine used, instead of the first one, in the sixth invention.

Note, the other routines are same as in the first invention.

The sixth invention varies the upper limit value of the purge rate at the start of the purge according to the vapor concentration of the fuel vapor absorbed in the charcoal canister 14, because the air-fuel ratio is hardly affected by a large purge rate when the vapor concentration of the fuel vapor absorbed in the charcoal canister 14 is low, but is largely affected by a large purge rate when it is high.

At step 1701, it is determined in which region the air-fuel ratio correction factor FAF belongs.

If the air-fuel ratio correction factor FAF belongs in region I at step 1701, the control proceeds to step 1702, where the purge rate PGR increases the purge rate increasing amount D, and the control proceeds to step 1704.

If the air-fuel ratio correction factor FAF belongs in region III at step 1701, the control proceeds to step 1703, where the purge rate PGR decreases the purge rate decreasing amount E, and the control proceeds to step 1704.

If the air-fuel ratio correction factor FAF belongs to region II at step 1701, the control proceeds directly to step 1704.

At step 1704, the first upper limit value of the purge rate PRMAX1 is calculated as the function of the vapor concentration index FGPG leaned in the vapor concentration learning routine shown in FIG. 3.

Figure 18:
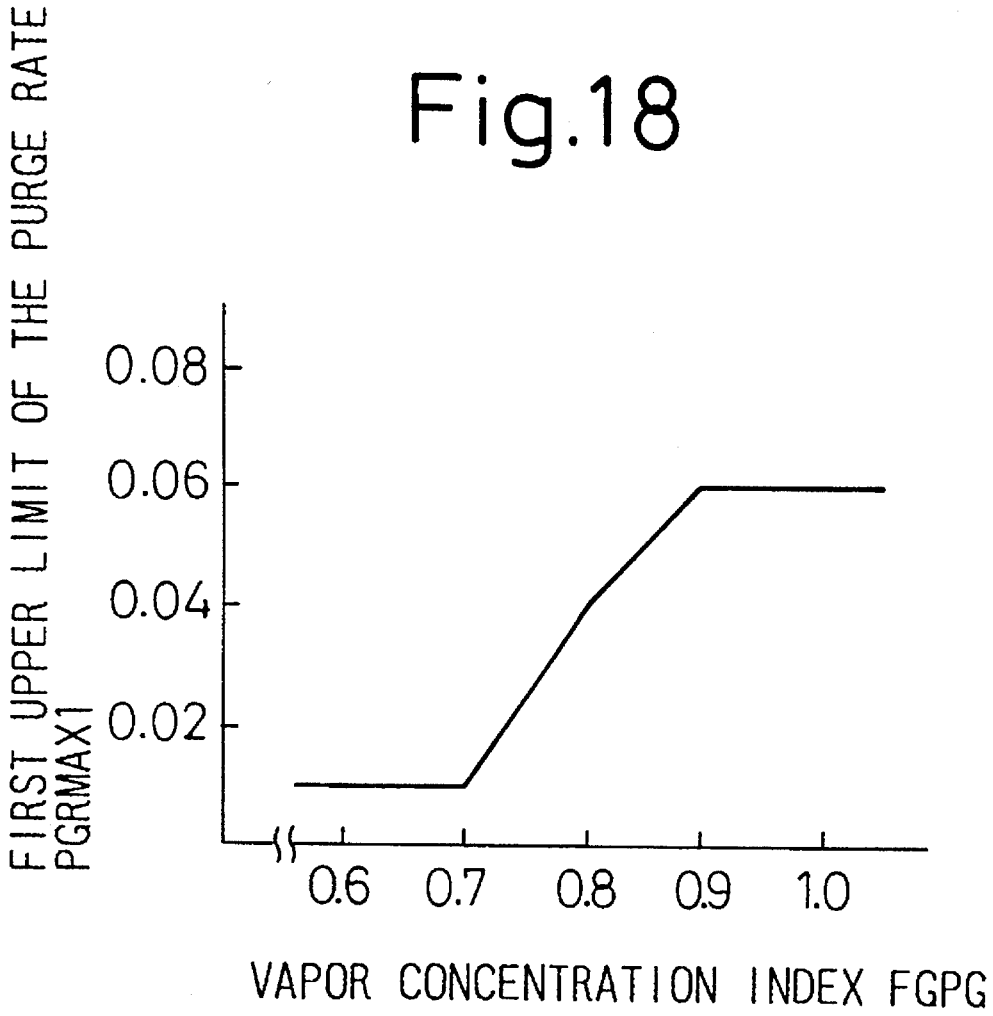
FIG. 18 is a graph for determining the first upper limit of the purge rate; and, FIG. 19 is a flow-chart of the seventh normal purge rate calculating routine.

FIG. 18 is the graph to determine the first upper limit value of the purge rate PRMAX1, and the ordinate shows the first upper limit value of the purge rate PRMAX1 and the abscissa shows the vapor concentration index FGPG.

Namely, the higher the vapor concentration index FGPG, that is, the lower fuel in the purge gas, the more the first upper limit value of the purge rate PRMAX1 is increased.

At step 1705, the second upper limit value of the purge rate PRMAX2 is calculated as the function of the vapor concentration index FGPG and the minimum required energizing interval of the fuel injection valve TAUMIN.

Namely, the second upper limit value of the purge rate PRMAX2 is the limit value to avoid the opening interval of the fuel injection valve TAU decreasing to less than the minimum required energizing time of the fuel injection valve TAUMIN.

At step 1706, it is determined whether or not the first upper limit value of the purge rate PRMAX1 is smaller than the second upper limit value of the purge rate PRMAX2.

If the determination at step 1706 is affirmative, the control proceeds to step 1707, where the upper limit value of the purge rate PRMAX is set to the first upper limit value of the purge rate PRMAX1, and the control proceeds to step 1709.

If the determination at step 1706 is negative, the control proceeds to step 1708, where the upper limit value of the purge rate PRMAX is set to the second upper limit value of the purge rate PRMAX2, and the control proceeds to step 1709.

At step 1709, it is determined whether or not the purge rate PGR is larger than the upper limit value of the purge rate PRMAX, and if the determination is affirmative, this routine is terminated after the purge rate PGR is set to the upper limit value of the purge rate PRMAX.

Note, if the determination at step 1709 is negative, this routine is directly terminated.

By using the apparatus for disposing of fuel-vapor according to the sixth invention, the fluctuation of the air-fuel ratio caused by the purge can be reduced, because the higher the purge concentration of the purge gas, the smaller the upper limit of the purge rate becomes.

Figure 19:
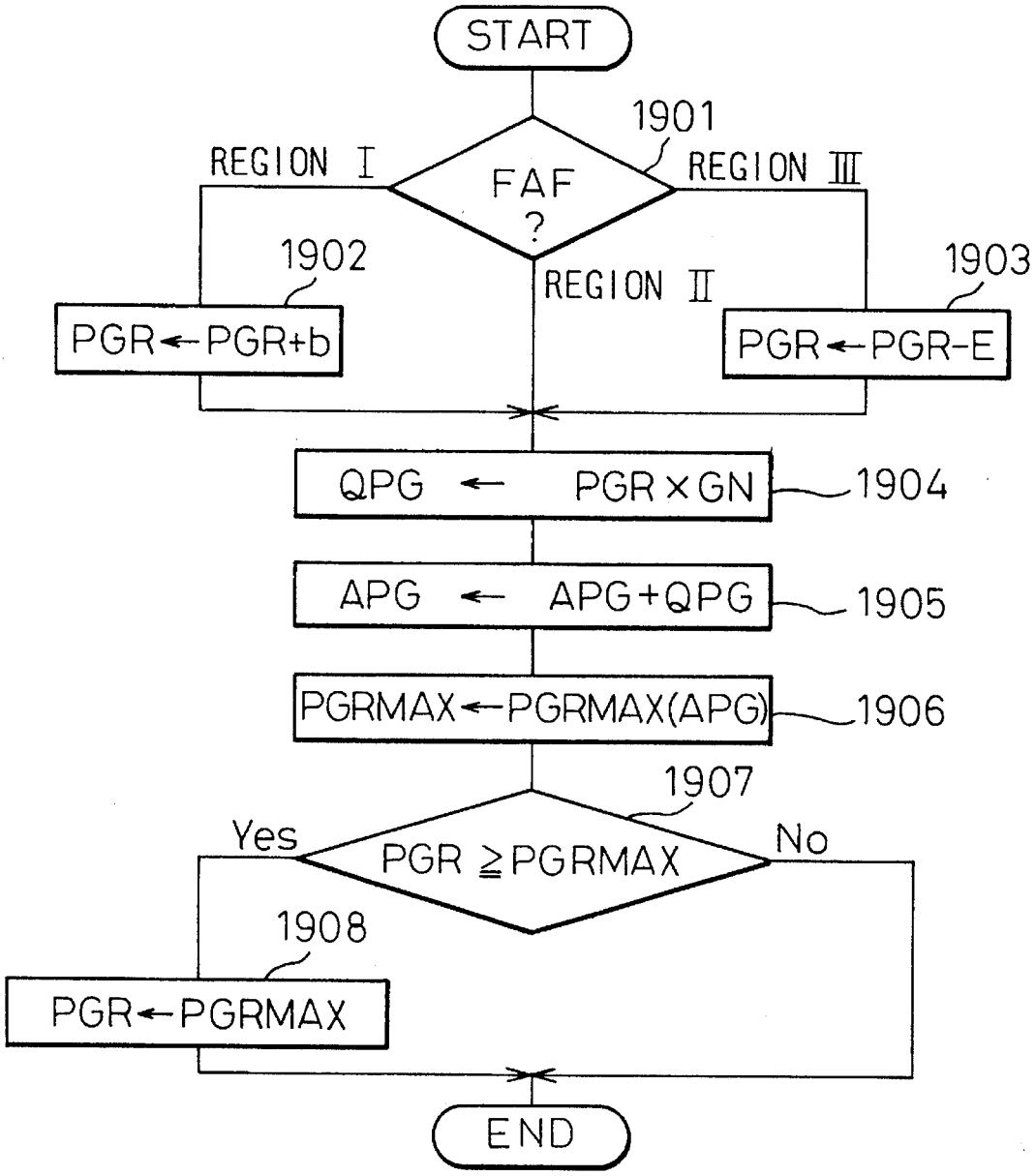

FIG. 19 is the flowchart of the seventh normal purge rate control routine used, instead of the first one, in the seventh invention.

Note, the other routines are same as the first invention.

In the seventh invention, the smaller the integral value of the purge amount, the smaller the upper limit value of the purge rate becomes, because the fuel amount in the purge gas is high at the starting of the purge, and becomes smaller as the purge proceeds.

At step 1901, it is determined in which region the air-fuel ratio correction factor FAF belongs.

If the air-fuel ratio correction factor FAF belongs in region I at step 1901, the control proceeds to step 1902, where the purge rate PGR increases the purge rate increasing amount D, and the control proceeds to step 1904.

If the air-fuel ratio correction factor FAF belongs in region III at step 1901, the control proceeds to step 1903, where the purge rate PGR decreases the purge rate decreasing amount E, and the control proceeds to step 1904.

If the air-fuel ratio correction factor FAF belongs in region II at step 1901, the control directly proceeds to step 1904.

At step 1904, the purge amount QPG is calculated by multiplying the inlet air amount GN detected by the air-flow meter 112 by the purge rate PGR.

At step 1905, the integral value of the purge amount APG is renewed by adding the old integral value of the purge amount APG and the present purge amount QPG.

As step 1906, the upper purge rate PGMAX is calculated from the integral value of the purge amount APG.

Note, the larger the integral value of the purge amount APG, the larger upper purge rate PGMAX becomes.

At step 1907, it is determined whether or not the purge rate PGR is larger than the upper purge rate PGMAX.

If the determination at step 1907 is affirmative, this routine is terminated after the purge rate PGR is set to the upper purge rate PGMAX.

If the determination at step 1907 is negative, this routine is directly terminated.

By using the apparatus for disposing of fuel-vapor according to the seventh invention, the fluctuation of the air-fuel ratio produced by the purge can be reduced, because the smaller the integral flow of the purge gas becomes, the smaller upper limit of the purge rate becomes.

We claim:

1. An apparatus for disposing of fuel-vapor comprising:

a charcoal canister for absorbing the fuel-vapor evaporating from a fuel tank of an engine;

a purge valve arranged in a purge pipe which connects said charcoal canister and an inlet pipe and controls the flow rate of the purge gas;

a purge rate calculating means for calculating a purge rate, that is, a rate of the purge gas to the inlet air, and limiting the changing rate of the purge rate to less than a predetermined threshold rate for the changing rate;

a purge valve opening output means for outputting the opening demand to said purge valve determined according to the purge rate calculated by said purge rate calculating means when the driving state of the engine allows the purge;

an air-fuel ratio detecting means arranged in an exhaust pipe of the engine for detecting the air-fuel ratio of the exhaust gas;

an air-fuel ratio control means for calculating an air-fuel ratio correction factor in order to control the air-fuel ratio detected by the said air-fuel ratio detecting means at a predetermined target air-fuel ratio;

a vapor concentration learning means for learning the vapor concentration of the fuel-vapor purged into the inlet pipe according to the air-fuel ratio correction factor calculated by said air-fuel ratio control means; and a fuel injection valve controlling means for controlling fuel injection valves in accordance with the air-fuel ratio correction factor calculated by said air-fuel ratio control means and the vapor concentration of the fuel-vapor learned by said vapor concentration learning means; wherein said purge rate calculating means further includes a first rate limiting means for limiting said threshold rate within a narrower range when the vapor concentration is not learned enough than when it is learned enough.

2. An apparatus for disposing of fuel-vapor comprising:

a charcoal canister for absorbing the fuel-vapor evaporated from a fuel tank of an engine;

a purge valve arranged on a purge pipe which connects said charcoal canister to an inlet pipe and controls the flow rate of the purge gas;

a purge rate calculating means for calculating a purge rate, that is, a ratio of the purge gas to the inlet air, and limiting a changing rate of the purge rate to less than a predetermined threshold rate for the changing rate;

a purge valve opening output means for outputting the opening demand to said purge valve determined according to the purge rate calculated by said purge rate calculating means when the driving state of the engine allows the purge;

an air-fuel ratio detecting means arranged in an exhaust pipe of the engine for detecting an air-fuel ratio of the exhaust gas;

an air-fuel ratio control means for calculating an air-fuel ratio correction factor in order to control the air-fuel ratio detected by the said air-fuel ratio detecting means at a predetermined target air-fuel ratio;

a vapor concentration learning means for learning the vapor concentration of the fuel-vapor purged into the inlet pipe according to the air-fuel ratio correction factor calculated by said air-fuel ratio control means;

a fuel injection valve controlling means for controlling fuel injection valves in accordance with the air-fuel ratio correction factor calculated by said air-fuel ratio control means and the vapor concentration of the fuel-vapor learned by said vapor concentration learning means; and a purge valve opening rate limiting means for limiting the opening rate of said purge valve to a lower rate when the vapor concentration is not learned enough than when it is learned enough.

3. An apparatus for disposing of fuel-vapor comprising:

a charcoal canister for absorbing the fuel-vapor evaporated from a fuel tank of an engine;

a purge valve arranged in a purge pipe which connects said charcoal canister to an inlet pipe and controls the flow rate of the purge gas;

a purge rate calculating means for calculating a purge rate, that is, the ratio of the purge gas to the inlet air, and limiting a changing rate of the purge rate to less than a predetermined threshold rate for the changing rate;

a purge valve opening output means for outputting the opening demand to said purge valve determined according to the purge rate calculated by said purge rate calculating means when the driving state of the engine allows the purge;

an air-fuel ratio detecting means arranged in an exhaust pipe of the engine for detecting an air-fuel ratio of the exhaust gas;

an air-fuel ratio control means for calculating an air-fuel ratio correction factor in order to control the air-fuel ratio detected by the said air-fuel ratio detecting means at a predetermined target air-fuel ratio;

a vapor concentration learning means for learning the vapor concentration of the fuel-vapor purged into the inlet pipe according to the air-fuel ratio correction factor calculated by said air-fuel ratio control means;

a fuel injection valve controlling means for controlling fuel injection valves in accordance with the air-fuel ratio correction factor calculated by said air-fuel ratio control means and the vapor concentration of the fuel-vapor learned by said vapor concentration learning means; and a rate limiting means for multiplying the purge rate calculated in said purge rate calculating means by the correction factor which is proportional to the degree of the learning of the vapor concentration in said vapor concentration learning means.

4. An apparatus for disposing of fuel-vapor comprising:

a charcoal canister for absorbing the fuel-vapor evaporated from a fuel tank of an engine;

a purge valve arranged on a purge pipe which connects said charcoal canister to an inlet pipe and controls the flow rate of the purge gas;

a purge rate calculating means for calculating a purge rate, that is, the ratio of the purge gas to the inlet air, and limiting the changing rate of the purge rate to less than a predetermined threshold rate for the changing rate;

a purge valve opening output means for outputting the opening demand to said purge valve determined according to the purge rate calculated by said purge rate calculating means when the driving state of the engine allows the purge;

an air-fuel ratio detecting means arranged in an exhaust pipe of the engine for detecting the air-fuel ratio of the exhaust gas;

an air-fuel ratio control means for calculating an air-fuel ratio correction factor in order to control the air-fuel ratio detected by the said air-fuel ratio detecting means at a predetermined target air-fuel ratio;

a vapor concentration learning means for learning the vapor concentration of the fuel-vapor purged into the inlet pipe according to the air-fuel ratio correction factor calculated by said air-fuel ratio control means;

a fuel injection valve controlling means for controlling fuel injection valves in accordance with the air-fuel ratio correction factor calculated by said air-fuel ratio control means and the vapor concentration of the fuel-vapor learned by said vapor concentration learning means; and a rate limiting means for setting the threshold rate lower when the engine is driving at a specific condition, that is, at a condition when the vapor concentration learned in said vapor concentration learning means is being increased and the air-fuel ratio detected by said air-fuel ratio detecting means stays rich or at the condition when the vapor concentration learned in said vapor concentration learning means is being decreased and the air-fuel ratio detected by said air-fuel ratio detecting means stays lean, than when the engine is driving at a condition other than the specific condition.

5. An apparatus for disposing of fuel-vapor comprising:

a charcoal canister for absorbing the fuel-vapor evaporated from a fuel tank of an engine;

a purge valve arranged in a purge pipe which connects said charcoal canister to an inlet pipe and controls the flow rate of the purge gas;

a purge rate calculating means for calculating a purge rate, that is, the ratio of the purge gas to the inlet air, and limiting the changing rate of the purge rate to less than a predetermined threshold rate for the changing rate;

a purge valve opening output means for outputting the opening demand for said purge valve determined according to the purge rate calculated by said purge rate calculating means when the driving state of the engine allows the purge;

an air-fuel ratio detecting means arranged in an exhaust pipe of the engine for detecting an air-fuel ratio of the exhaust gas;

an air-fuel ratio control means for calculating an air-fuel ratio correction factor in order to control the air-fuel ratio detected by the said air-fuel ratio detecting means at a predetermined target air-fuel ratio;

a vapor concentration learning means for learning the vapor concentration of the fuel-vapor purged into the inlet pipe according to the air-fuel ratio correction factor calculated by said air-fuel ratio control means;

a fuel injection valve controlling means for controlling fuel injection valves in accordance with the air-fuel ratio correction factor calculated by said air-fuel ratio control means and the vapor concentration of the fuel-vapor learned by said vapor concentration learning means; and a rate limiting means for setting the threshold rate larger when the renewal rate of the air-fuel ratio coefficient calculated in said air-fuel ratio control means is high than when it is low.

6. An apparatus for disposing of fuel-vapor comprising:

a charcoal canister for absorbing the fuel-vapor evaporated from a fuel tank of an engine;

a purge valve arranged in a purge pipe which connects said charcoal canister to an inlet pipe and controls the flow rate of the purge gas;

a purge rate calculating means for calculating the purge rate, that is, the ratio of the purge gas to the inlet air, and limiting the changing rate of the purge rate to less than a predetermined threshold rate for the changing rate;

a purge valve opening output means for outputting the opening demand for said purge valve determined according to the purge rate calculated by said purge rate calculating means when the driving state of the engine allows the purge;

an air-fuel ratio detecting means arranged in an exhaust pipe of the engine for detecting an air-fuel ratio of the exhaust gas;

an air-fuel ratio control means for calculating an air-fuel ratio correction factor in order to control the air-fuel ratio detected by the said air-fuel ratio detecting means at a predetermined target air-fuel ratio;

a vapor concentration learning means for learning the vapor concentration of the fuel-vapor purged into the inlet pipe according to the air-fuel ratio correction factor calculated by said air-fuel ratio control means;

a fuel injection valve controlling means for controlling fuel injection valves in accordance with the air-fuel ratio correction factor calculated by said air-fuel ratio control means and the vapor concentration of the fuel-vapor learned by said vapor concentration learning means; and a purge rate limiting means for limiting the purge rate calculated in said purge rate calculating means to less than an upper limit for the purge rate which is smaller when the vapor-concentration learned in said vapor concentration learning means is high, than when it is low.

7. An apparatus for disposing of fuel-vapor comprising:

a charcoal canister for absorbing the fuel-vapor evaporated from a fuel tank of an engine;

a purge valve arranged on a purge pipe which connects said charcoal canister to an inlet pipe and controls the flow rate of the purge gas;

a purge rate calculating means for calculating the purge rate, that is, the ratio of the purge gas to the inlet air, and limiting a changing rate of the purge rate to less than a predetermined threshold rate for the changing rate;

a purge valve opening output means for outputting the opening demand for said purge valve determined according to the purge rate calculated by said purge rate calculating means when the driving state of the engine allows the purge;

an air-fuel ratio detecting means arranged in an exhaust pipe of the engine for detecting an air-fuel ratio of the exhaust gas;

an air-fuel ratio control means for calculating an air-fuel ratio correction factor in order to control the air-fuel ratio detected by the said air-fuel ratio detecting means at a predetermined target air-fuel ratio;

a vapor concentration learning means for learning the vapor concentration of the fuel-vapor purged into the inlet pipe according to the air-fuel ratio correction factor calculated by said air-fuel ratio control means;

a fuel injection valve controlling means for controlling fuel injection valves in accordance with the air-fuel ratio correction factor calculated by said air-fuel ratio control means and the vapor concentration of the fuel-vapor learned by said vapor concentration learning means;

a purge amount integrating means for integrating the purge amount; and a purge rate limiting means for limiting the purge rate calculated in said purge rate calculating means to less than an upper limit for the purge rate which is smaller when the integral purge amount calculated in said purge amount integrating means is small, than when it is large.

8. A method of disposing of fuel-vapor comprising the steps of:

calculating the purge rate, that is, the ratio of the purge gas to the inlet air, and limiting the changing rate of the purge rate to less than a predetermined threshold rate for the changing rate;

outputting the opening demand for a purge valve determined according to the purge rate calculated by the purge rate calculating step when the driving condition of an engine allows the purge;

calculating an air-fuel ratio correction factor in order to control the air-fuel ratio detected by an air-fuel ratio detecting sensor at a predetermined target air-fuel ratio; and learning the vapor concentration of the fuel-vapor purged into an inlet pipe according to the air-fuel ratio correction factor calculated by said air-fuel ratio calculating step; and controlling fuel injection valves in accordance with the air-fuel ratio correction factor calculated at said air-fuel ratio calculating step and the vapor concentration of the fuel-vapor learned at said vapor concentration learning step; wherein said purge rate calculating step further includes a step for limiting the threshold rate to within a narrower range when the vapor concentration is less learned than when it is learned enough.

9. A method of disposing of fuel-vapor comprising the steps of:

calculating a purge rate, that is, a ratio of the purge gas to the inlet air, and limiting the changing rate of the purge rate to less than a predetermined threshold rate for the changing rate;

outputting the opening demand for a purge valve determined according to the purge rate calculated by the purge rate calculating step when the driving condition of an engine allows the purge;

calculating an air-fuel ratio correction factor in order to control the air-fuel ratio detected by an air-fuel ratio detecting sensor at a predetermined target air-fuel ratio;

learning the vapor concentration of the fuel-vapor purged into an inlet pipe according to the air-fuel ratio correction factor calculated by said air-fuel ratio calculating step;

controlling fuel injection valves in accordance with the air-fuel ratio correction factor calculated at said air-fuel ratio calculating step and the vapor concentration of the fuel-vapor learned at said vapor concentration learning step; and limiting the opening rate of the purge valve at a lower rate when the vapor concentration is less learned than when it is learned enough.

10. A method of disposing of fuel-vapor comprising the steps of:

calculating a purge rate, that is, a ratio of the purge gas to the inlet air, and limiting the changing rate of the purge rate to less than a predetermined threshold rate for the changing rate;

outputting the opening demand for a purge valve determined according to the purge rate calculated by the purge rate calculating step when the driving condition of an engine allows the purge;

calculating an air-fuel ratio correction factor in order to control the air-fuel ratio detected by an air-fuel ratio detecting sensor at a predetermined target air-fuel ratio;

learning the vapor concentration of the fuel-vapor purged into an inlet pipe according to the air-fuel ratio correction factor calculated by said air-fuel ratio calculating step;

controlling fuel injection valves in accordance with the air-fuel ratio correction factor calculated at said air-fuel ratio calculating step and the vapor concentration of the fuel-vapor learned at said vapor concentration learning step; and multiplying the purge rate calculated in said purge rate calculating step by a correction factor which is proportional to the degree of the learning of the vapor concentration determined in said vapor concentration learning step.

11. A method of disposing of fuel-vapor comprising the steps of:

calculating a purge rate, that is, a ratio of the purge gas to the inlet air, and limiting the changing rate of the purge rate to less than a predetermined threshold rate for the changing rate;

outputting the opening demand for a purge valve determined according to the purge rate calculated by the purge rate calculating step when the driving condition of an engine allows the purge;

calculating an air-fuel ratio correction factor in order to control the air-fuel ratio detected by an air-fuel ratio detecting sensor at a predetermined target air-fuel ratio;

learning the vapor concentration of the fuel-vapor purged into an inlet pipe according to the air-fuel ratio correction factor calculated by said air-fuel ratio calculating step;

controlling fuel injection valves in accordance with the air-fuel ratio correction factor calculated at said air-fuel ratio calculating step and the vapor concentration of the fuel-vapor learned at said vapor concentration learning step; and setting the threshold rate smaller when the engine is driving at a specific condition, that is, when the vapor concentration learned in said vapor concentration learning step is being increased and the air-fuel ratio detected by a air-fuel ratio sensor stays rich or when the vapor concentration learned in said vapor concentration learning step is being decreased and the air-fuel ratio detected by said air-fuel ratio sensor stays lean, than when the engine is driving at a condition other than the specific condition.

12. A method of disposing of fuel-vapor comprising the steps of:

calculating a purge rate, that is, the ratio of the purge gas to the inlet air, and limiting the changing rate of the purge rate to less than a predetermined threshold rate for the changing rate;

outputting the opening demand for a purge valve determined according to the purge rate calculated by the purge rate calculating step when the driving condition of an engine allows the purge;

calculating an air-fuel ratio correction factor in order to control the air-fuel ratio detected by an air-fuel ratio detecting sensor at a predetermined target air-fuel ratio;

learning the vapor concentration of the fuel-vapor purged into an inlet pipe according to the air-fuel ratio correction factor calculated by said air-fuel ratio calculating step;

controlling fuel injection valves in accordance with the air-fuel ratio correction factor calculated at said air-fuel ratio calculating step and the vapor concentration of the fuel-vapor learned at said vapor concentration learning step; and setting the threshold rate faster when the renewal rate of the air-fuel ratio coefficient calculated in said air-fuel ratio control step is high, than when it is low.

13. A method of disposing of fuel-vapor comprising the steps of:

calculating a purge rate, that is, a ratio of the purge gas to the inlet air, and limiting the changing rate of the purge rate to less than a predetermined threshold rate for the changing rate;

outputting the opening demand for a purge valve determined according to the purge rate calculated by the purge rate calculating step when the driving condition of an engine allows the purge;

calculating an air-fuel ratio correction factor in order to control the air-fuel ratio detected by an air-fuel ratio detecting sensor at a predetermined target air-fuel ratio;

learning the vapor concentration of the fuel-vapor purged into an inlet pipe according to the air-fuel ratio correction factor calculated by said air-fuel ratio calculating step;

controlling fuel injection valves in accordance with the air-fuel ratio correction factor calculated at said air-fuel ratio calculating step and the vapor concentration of the fuel-vapor learned at said vapor concentration learning step; and limiting the purge rate calculated in said purge rate calculating step to less than an upper limit for the purge rate which is larger when the vapor-concentration calculated in said vapor concentration learning step is high than when it is low.

14. A method of disposing of fuel-vapor comprising the steps of:

calculating a purge rate, that is, a ratio of the purge gas to the inlet air, and limiting the changing rate of the purge rate to less than a predetermined threshold rate for the changing rate; outputting the opening demand for a purge valve determined according to the purge rate calculated by the purge rate calculating step when the driving condition of an engine allows the purge;

calculating an air-fuel ratio correction factor in order to control the air-fuel ratio detected by an air-fuel ratio detecting sensor at a predetermined target air-fuel ratio;

learning the vapor concentration of the fuel-vapor purged into an inlet pipe according to the air-fuel ratio correction factor calculated by said air-fuel ratio calculating step;

controlling fuel injection valves in accordance with the air-fuel ratio correction factor calculated at said air-fuel ratio calculating step and the vapor concentration of the fuel-vapor learned at said vapor concentration learning step;

integrating the purge amount; and limiting means for limiting the purge rate calculated in said purge rate calculating step to less than an upper limit for the purge rate which is smaller when the integral purge amount calculated in said purge amount integrating step is small than when it is large.

* * * * *